US007513757B2

(12) United States Patent
Gibson et al.

(10) Patent No.: US 7,513,757 B2
(45) Date of Patent: Apr. 7, 2009

(54) PERISTALTIC PUMP HEAD AND TUBE HOLDER

(75) Inventors: David John Michael Gibson, Wellington (NZ); Terence Donald Bannister, Wellington (NZ)

(73) Assignee: Impian Technologies Limited, Karori, Wellington (NZ)

( * ) Notice: Subject to any disclaimer, the term of this patent is extended or adjusted under 35 U.S.C. 154(b) by 339 days.

(21) Appl. No.: 10/540,286

(22) PCT Filed: Dec. 22, 2003

(86) PCT No.: PCT/NZ03/00286

§ 371 (c)(1),
(2), (4) Date: Jan. 9, 2006

(87) PCT Pub. No.: WO2004/057190

PCT Pub. Date: Jul. 8, 2004

(65) Prior Publication Data

US 2006/0153718 A1 Jul. 13, 2006

(30) Foreign Application Priority Data

Dec. 20, 2002 (NZ) ..... 523300

(51) Int. Cl.
*F04B 43/08* (2006.01)
*F04B 43/12* (2006.01)
*F04B 45/06* (2006.01)

(52) U.S. Cl. ..... 417/477.2; 417/477.3; 417/477.9; 417/477.5; 417/477.6; 417/477.12

(58) Field of Classification Search ..... 417/447.1, 417/477.1, 477.5, 474, 477.2, 477.9, 477.12, 417/477.3, 477.6
See application file for complete search history.

(56) References Cited

U.S. PATENT DOCUMENTS 3,137,240 A 6/1964 Hunt (Continued)

FOREIGN PATENT DOCUMENTS

EP 0053813 2/1986

(Continued)

OTHER PUBLICATIONS

Technical Disclosure Bulletin, pp. 1816-1817, "Peristaltic Pump With Easy Tube Load Feature".

(Continued)

*Primary Examiner*—Devon C Kramer
*Assistant Examiner*—Amene S Bayou
(74) *Attorney, Agent, or Firm*—Dann, Dorfman, Herrell and Skillman, P.C.

(57) ABSTRACT

A tube holder (105) for use with a peristaltic pump includes a housing having a recess (165) for receipt of a pump rotor and a tube race around the recess. The tube race has a first race part and a second race part, a first tube inlet (167*a*) into the first race part and a first tube outlet (167*b*) from the first race part, a second tube inlet (167*c*) into the second race part and a second tube outlet (167*d*) from the second race part. The tube is insertable in the tube race by movement in a substantially orthogonal direction relative to the tube race so that it extends in through the first tube inlet (167*a*), around the first race part, out through the first tube outlet (167*b*), in through the second tube inlet (167*c*), around the second race part, and out through the second tube outlet (167*d*).

42 Claims, 17 Drawing Sheets

U.S. PATENT DOCUMENTS

| | | | | | |
|---|---|---|---|---|---|
| 3,138,104 | A | | 6/1964 | Cantor | |
| 3,180,272 | A | | 4/1965 | Broadfoot | |
| 3,674,383 | A | | 7/1972 | Iles | |
| 3,698,381 | A | | 10/1972 | Federico et al. | |
| 3,768,653 | A | | 10/1973 | Brumfield | |
| 3,822,948 | A | * | 7/1974 | Handl | 401/146 |
| 3,842,536 | A | | 10/1974 | Schick | |
| 3,923,657 | A | | 12/1975 | Roser | |
| 3,955,902 | A | | 5/1976 | Kyvsgaard | |
| 3,963,023 | A | | 6/1976 | Hankinson | |
| 4,010,054 | A | | 3/1977 | Bradt | |
| 4,043,712 | A | | 8/1977 | Azzolini | |
| 4,131,399 | A | | 12/1978 | Calvet | |
| 4,132,509 | A | | 1/1979 | Bongartz et al. | |
| 4,174,193 | A | | 11/1979 | Sakakibara | |
| 4,178,138 | A | | 12/1979 | Iles | |
| 4,201,525 | A | | 5/1980 | Brown et al. | |
| 4,215,688 | A | | 8/1980 | Terman et al. | |
| 4,218,197 | A | | 8/1980 | Meyer et al. | |
| 4,392,794 | A | * | 7/1983 | Foxcroft | 417/475 |
| 4,412,793 | A | | 11/1983 | Stenberg et al. | |
| 4,498,843 | A | | 2/1985 | Schneider et al. | |
| 4,522,571 | A | | 6/1985 | Little | |
| 4,530,647 | A | | 7/1985 | Uno | |
| 4,545,744 | A | * | 10/1985 | Weber et al. | 417/475 |
| 4,548,553 | A | | 10/1985 | Ferster | |
| 4,552,516 | A | | 11/1985 | Stanley | |
| 4,558,996 | A | | 12/1985 | Becker | |
| 4,564,342 | A | * | 1/1986 | Weber et al. | 417/477.6 |
| 4,573,884 | A | | 3/1986 | Troutner | |
| 4,573,887 | A | | 3/1986 | Smith | |
| 4,662,355 | A | | 5/1987 | Pieronne et al. | |
| 4,674,962 | A | * | 6/1987 | Gardineer | 417/477.3 |
| 4,678,414 | A | | 7/1987 | Raymond, Jr. | |
| 4,751,791 | A | | 6/1988 | Al-Rawi | |
| 4,878,622 | A | | 11/1989 | Jamison et al. | |
| 4,886,431 | A | | 12/1989 | Soderquist et al. | |
| 4,909,713 | A | | 3/1990 | Finsterwald et al. | |
| 4,943,279 | A | | 7/1990 | Samiotes et al. | |
| 4,954,055 | A | * | 9/1990 | Raible et al. | 417/477.5 |
| 4,974,674 | A | | 12/1990 | Wells | |
| 4,982,903 | A | | 1/1991 | Jamison et al. | |
| 5,035,440 | A | | 7/1991 | Chappell | |
| 5,058,669 | A | | 10/1991 | Wells | |
| 5,062,775 | A | | 11/1991 | Orth | |
| 5,110,270 | A | | 5/1992 | Morrick | |
| 5,154,357 | A | | 10/1992 | Jamison et al. | |
| 5,193,750 | A | | 3/1993 | LaMontagne et al. | |
| 5,237,878 | A | | 8/1993 | Hackenberg | |
| 5,256,041 | A | | 10/1993 | Tucker | |
| 5,342,181 | A | | 8/1994 | Schock et al. | |
| 5,353,692 | A | | 10/1994 | Reese et al. | |
| 5,411,210 | A | | 5/1995 | Gimple et al. | |
| 5,429,486 | A | | 7/1995 | Schock et al. | |
| 5,445,506 | A | | 8/1995 | Afflerbaugh et al. | |
| 5,533,877 | A | | 7/1996 | Friedmann et al. | |
| 5,616,125 | A | | 4/1997 | Jelks | |
| 5,746,708 | A | | 5/1998 | Giesler et al. | |
| 5,817,001 | A | | 10/1998 | Leschinsky et al. | |
| 5,868,696 | A | | 2/1999 | Giesler et al. | |
| 5,901,698 | A | | 5/1999 | Welles | |
| 5,922,944 | A | | 7/1999 | Pieroni et al. | |
| 5,928,177 | A | | 7/1999 | Brugger et al. | |
| 5,941,635 | A | | 8/1999 | Stewart | |
| 5,954,486 | A | | 9/1999 | Iwata | |
| 6,067,668 | A | | 5/2000 | Rudd | |
| 6,102,678 | A | * | 8/2000 | Peclat | 417/477.7 |
| 6,138,665 | A | | 10/2000 | Welles | |
| 6,149,621 | A | | 11/2000 | Makihara | |
| 6,626,355 | B2 | | 9/2003 | Sasse et al. | |
| 2002/0120230 | A1 | * | 8/2002 | Miles et al. | 604/80 |
| 2003/0053914 | A1 | | 3/2003 | Iehl et al. | |

FOREIGN PATENT DOCUMENTS

| | | |
|---|---|---|
| EP | 0776670 | 9/2001 |
| GB | 2138511 | 10/1984 |
| JP | 1017543 | 1/2001 |
| WO | 9006675 | 6/1990 |
| WO | 9300941 | 1/1993 |
| WO | 9709075 | 3/1997 |
| WO | 9824637 | 6/1998 |
| WO | 9943269 | 9/1999 |
| WO | 0191831 | 12/2001 |

OTHER PUBLICATIONS

Technical Disclosure Bulletin, pp. 987-988, "Peristaltic Roller Pump", Aug. 1977.

* cited by examiner

PERISTALTIC PUMP HEAD AND TUBE HOLDER

FIELD OF THE INVENTION

The invention relates to a peristaltic pump head for pumping fluids, and to a tube holder for use with a peristaltic pump head.

BACKGROUND OF TEE INVENTION

A large number of applications require the pumping of fluids. Standard pumps result in the fluid coming into contact with the pumping apparatus, thereby risking contamination of the fluid. Peristaltic pumps operate by occluding a tube containing the fluid, so that the fluid only comes into contact with the interior of the tube, and not the pumping head or other pumping components.

One problem faced with conventional peristaltic pumps is maintaining the tube in a desired position within the tube race, as if the tube moves with movement of the pumping head, the fluid will not be pumped efficiently.

Another issue with conventional peristaltic pumps is maintaining correct alignment between the pump head and the tube in the raceway, and maintaining the desired pressure on the tube for consistent fluid pumping.

It is an object of at least a preferred embodiment of the present invention to provide a peristaltic pump head and/or tube holder which address at least one of the issues outlined above and/or which at least provides the public with a useful choice.

SUMMARY OF THE INVENTION

In accordance with a first aspect of the present invention, there is provided a tube holder for use with a peristaltic pump, the tube holder including: a housing having a recess for receipt of a pump rotor, a tube race for receipt of a tube around the recess and having a first race part around one part of the recess and a second race part around another part of the recess, a first tube inlet into the first race part and a first tube outlet from the first race part, a second tube inlet into the second race part and a second tube outlet from the second race part;

the tube being insertable in the tube race by movement in a substantially orthogonal direction relative to the tube race so that it extends in through the first tube inlet, around the first race part, out through the first tube outlet, in through the second tube inlet, around the second race part, and out through the second tube outlet.

The first tube outlet and second tube inlet are suitably configured such that the tube can exit the housing between the first outlet and second inlet.

The first tube outlet and second tube inlet may be in communication with a recess or groove which is separate to the tube race, but which is located within the housing.

The housing advantageously includes a lip or projection between the first outlet and the second inlet, behind which the tube can be located to maintain the tube in position within the tube race.

The recess may be tapered for receipt of a tapered pump rotor. Preferably, each tube race part is defined by a channel or groove extending inwardly from a respective tube inlet and tube outlet. The grooves suitably extend part way around the recess. Preferably, the recess provides surfaces against which the tube is occluded to pump fluid therethrough in use.

The tube holder may be a one-piece article.

The tube holder may be provided in combination with a pump head having a tapered rotor which is received in the recess of the tube holder, such that actuation of the pump head causes fluid to be pumped through a tube in the tube holder by occlusion of the tube.

The tube is suitably resiliently flexible so that it returns substantially to its original shape following occlusion, to thereby suck fluid through the tube.

Preferably, the rotor is axially biased towards its tapered end, such that the pump rotor and tube race are self-adjusting, to maintain a desired pressure on a tube in the tube race during pumping. The rotor may be axially biased by a compression spring.

The pump head preferably includes a stop to limit the axial movement of the rotor relative to the housing. The stop is suitably in the form of an annular lip on the rotor.

Preferably, the pump head includes a transmission mechanism to transmit motive power from a power source to the rotor, and the base of the tapered rotor includes a plurality of gear teeth which engage with a gear of the transmission mechanism, with the gear teeth of the rotor and the teeth of the gear of the transmission mechanism of sufficient length to remain engaged during axial movement of the rotor. The gear teeth of the rotor are suitably elongate and longer than the teeth of the gear.

Part of the rotor may be substantially conical or frustoconical, and advantageously has a plurality of rollers rotatably mounted thereon which are configured to occlude the tube in use. The rollers are suitably substantially frustoconical in configuration, with their tapered ends directed towards the tapered end of the rotor. The rollers are suitably mounted for rotation with axes which taper toward the tapered end of the rotor.

The rotor preferably includes a main body part and a head part, with the rollers mounted for rotation in a recess or recesses between the main body part and the head part.

The tube holder and pump head may be fully separable from an operable configuration in which the rotor is located in the recess of the tube holder and configured to pump fluid through a tube to a loading configuration in which the tube may be loaded into the tube race.

In accordance with a second aspect of the present invention, there is provided a method of loading a tube into a tube holder including:

providing a tube holder having a housing having a recess for receipt of a pump rotor, a tube race for receipt of a tube around the recess and having a first race part around one part of the recess and a second race part around another part of the recess, a first tube inlet into the first race part and a first tube outlet from the first race part, a second tube inlet into the second race part and a second tube outlet from the second race part;

providing a tube; and moving the tube in a substantially orthogonal direction relative to the tube race such that it extends in through the first tube inlet, around the first race part, out through the first tube outlet, in through the second tube inlet, around the second race part, and out through the second tube outlet.

The tube holder may be as outlined in the first aspect above.

The tube holder preferably includes a retainer which is in the form of a projection or lip between the first outlet and the second inlet, and the method may further include pulling the installed tube in a direction away from the projection or lip so that the tube is maintained in position within the tube race with part of the tube located behind the projection or lip.

The method suitably includes bringing the tube holder into engagement with a pump head to provide the combination of a tube holder and a pump head and so that the rotor is located in the recess in the tube holder.

The combination may be as outlined above.

In accordance with a third aspect of the present invention, there is provided the combination of a peristaltic pump head having a tapered pump rotor which is rotatable about an axis of rotation, and a tube holder having a recess for receipt of the tapered end of the rotor, the tube holder having a tube race configured for receipt of a tube for pumping of a fluid by movement of the rotor, the tube race including a plurality of separate race parts around the recess defined by a plurality of apertures or recesses such that the tube can exit and re-enter the tube race The tube is preferably insertable into the tube race without separating the tube holder from the pump head.

Preferably, the tube holder and pump head are movable from an operable configuration in which the rotor is located in the recess of the tube holder and configured to pump fluid through a tube to a loading configuration in which the tube may be loaded into the tube race. Advantageously, the tube holder and pump head are fully separable.

In a preferred embodiment, the tube holder has a housing, a first tube race part around one part of the recess defined by a first tube inlet aperture and a first tube outlet aperture, and a second tube race part around another part of the recess defined by a second tube inlet aperture and a second tube outlet aperture, such that movement of a tube threaded therethrough in the axial direction of the rotor is minimised or prevented by the apertures.

The tube holder may be as outlined in the first aspect above.

The tube is suitably resiliently flexible so that it returns substantially to its original shape following occlusion, to thereby suck fluid through the tube.

The rotor is suitably axially biased towards its tapered end, such that the pump rotor and tube race are self-adjusting, to maintain a desired pressure on a tube in the tube race during pumping.

Preferably, the rotor is axially biased by a compression spring.

The pump head preferably includes a stop to limit the axial movement of the rotor relative to the housing. The stop is suitably in the form of an annular lip on the rotor.

The pump head preferably includes a transmission mechanism to transmit motive power from a power source to the rotor, and the base of the tapered rotor preferably includes a plurality of gear teeth which engage with a gear of the transmission mechanism, with the gear teeth of the rotor and the teeth of the gear of the transmission mechanism of sufficient length to remain engaged during axial movement of the rotor. The gear teeth of the rotor are suitably elongate and longer than the teeth of the gear.

Preferably, the tapered part of the rotor is substantially conical or frustoconical, and has a plurality of rollers rotatably mounted thereon which are configured to occlude the tube in use.

The rollers are suitably substantially frustoconical in configuration, with their tapered ends directed towards the tapered end of the rotor. The rollers may be mounted for rotation with axes which taper toward the tapered end of the rotor.

Preferably, the rotor includes a main body part and a head part, with the rollers mounted for rotation in a recess or recesses between the main body part and the head part.

In accordance with a fourth aspect of the present invention, there is provided a peristaltic pump head, including:

a housing;

a transmission mechanism for transmitting motive force from a drive mechanism to a rotor, and including a gear with a plurality of teeth;

a tapered pump rotor mounted for rotation about an axis of rotation within the housing and which is axially biased towards its tapered end, the base of the tapered pump rotor including gear teeth which engage with the teeth of the gear of the transmission mechanism, wherein the gear teeth of the rotor and the teeth of the gear of the transmission mechanism are of sufficient length to remain engaged during axial movement of the rotor relative to the housing.

The gear teeth of the rotor are suitably elongate and longer than the teeth of the gear.

Preferably, the transmission mechanism includes a plurality of gears.

The rotor may be axially biased by a compression spring.

The pump head preferably includes a stop to limit the axial movement of the rotor relative to the housing. The stop may be in the form of an annular lip on the rotor.

In accordance with a fifth aspect of the present invention, there is provided a kit of parts for assembling a peristaltic pump head assembly, including:

a rotor and a housing having first and second housing parts and configured for receipt of the rotor; which rotor may be assembled with the housing with at least part of the rotor exposed from the housing for engagement with a tube, by snapping the housing parts together such that the pump head assembly can be assembled without the use of adhesives or separate fasteners.

Advantageously, the rotor is provided in kit form, and includes a main body part, a head part and at least one roller, which rotor may be assembled by snapping the main body part and head part together to sandwich the roller(s) therebetween.

Preferably, the rotor is tapered and is mountable for rotation about an axis of rotation within the housing and to be axially biased towards its tapered end, and wherein the rotor includes a stop to limit the axial movement of the rotor relative to the housing when assembled.

The kit may include a compression spring to axially bias the rotor relative to the housing.

A base of the tapered rotor preferably includes gear teeth, and the kit includes a gear with a plurality of teeth to transmit motive force from a drive mechanism to the rotor, the gear teeth of the rotor and the teeth of the gear being of sufficient length to remain engaged during axial movement of the rotor relative to the housing once assembled.

All components are preferably made of a plastics material. Alternatively, all components other than the spring may be made of a plastics material.

In accordance with a sixth aspect of the present invention, there is provided a flexible container having a reservoir for holding fluid and including a tube holder directly connected to the flexible container, the tube holder having a tube race around a tapered aperture or recess configured for receipt of a tapered rotor of a peristaltic pump head, and a tube connector configured for connection to a resiliently flexible tube and in fluid communication with the reservoir, which tube holder can be brought into operable connection with the pump head to occlude fluid through a tube connected to the tube connector and extending around the tube race to dispense fluid from the container.

The container preferably includes a resiliently flexible tube connected to the tube connector and extending around the tube race.

In accordance with a seventh aspect of the present invention, there is provided a flexible container having a reservoir for holding fluid and including a tube holder directly connected to the flexible container, the tube holder having a tube race around a tapered aperture or recess configured for receipt of a tapered rotor of a peristaltic pump head, and a resiliently flexible tube in fluid communication with the reservoir and extending around the tube race, so that the tube holder can be brought into operable connection with the pump head to occlude fluid through the tube extending around the tube race.

The flexible container of the sixth or seventh aspect may include a plurality of reservoirs sealed from one another, and the tube holder may include a corresponding number of tube races so that the contents of the reservoirs can be independently dispensed via respective tubes.

Preferably, the tube race(s) has/have a first race part around one part of the recess and a second race part around another part of the recess, a first tube inlet into the first race part and a first tube outlet from the first race part, a second tube inlet into the second race part and a second tube outlet from the second race part; the respective tube being insertable in the respective tube race by movement in a direction substantially orthogonal to the tube race so that it extends in through the first tube inlet, around the first race part out through the first tube outlet, in through the second tube inlet, around the second race par, and out through the second tube outlet.

The tube holder preferably includes a lip or projection between the first outlet(s) and second inlet(s), behind which the respective tube can be located to maintain the tube in position within the tube race.

The container preferably includes a neck portion and two separate reservoir portions in a Y-configuration.

The tube holder may include at least one mounting boss which is located in an aperture in a neck of the container.

An aperture may extend through the mounting boss(es) and into a spigot(s) which comprise(s) the tube connector to which a respective tube is connected, such that tube(s) is/are in fluid communication with a respective reservoir.

In accordance with an eighth aspect of the present invention, there is provided a container holding at least one fluid for dispensing by a peristaltic pump, the container including a plurality of discrete magnetic or magnetisable areas in predetermined positions on the container to identify the container, which magnetic or magnetisable areas (once magnetised) are configured for detection by a pump assembly having a plurality of sensors in predetermined positions corresponding to the positions of the magnetic or magnetisable areas.

The may be of the type outlined in the sixth or seventh aspects above, and the magnetic or magnetisable areas may be located on the tube holder.

The plurality of magnetic areas may be provided by magnets. Alternatively, the plurality of magnetisable areas may be provided by one or more strips of material, discrete part(s) of which can been magnetised. As another alternative, the plurality of magnetisable areas may be provided by a plurality of items of a material which has no magnetic properties until magnetised.

The container may be in combination with a pump assembly including a plurality of sensors in predetermined positions corresponding to the positions of the magnetic or magnetisable areas, the sensors configured to sense whether the corresponding positions are magnetic or magnetised when the container is in close proximity or contact with the pump assembly.

There may be a greater number of sensors than there are magnetic or magnetised areas on the container.

The pump assembly may further include a microprocessor and a memory, which microprocessor is configured to determine from the sensors the numbers and positions of the magnetic or magnetised areas, and to then access the memory to determine the substance(s) in the container. The microprocessor may be configured to activate a software routine associated with the substance(s) of the container if the number and position of the magnetic or magnetised areas corresponds to a value stored in the memory. The software routine preferably determines when pump(s) of the pump assembly should be actuated, for how long, and in which combination.

The sensors may be Hall Effect sensors.

The invention consists in the foregoing and also envisages constructions of which the following gives examples only.

BRIEF DESCRIPTION OF THE DRAWINGS

Preferred embodiments of the present invention will be described by way of example only with reference to the accompanying figures in which.

DETAILED DESCRIPTION OF PREFERRED FORMS

Figure 1:
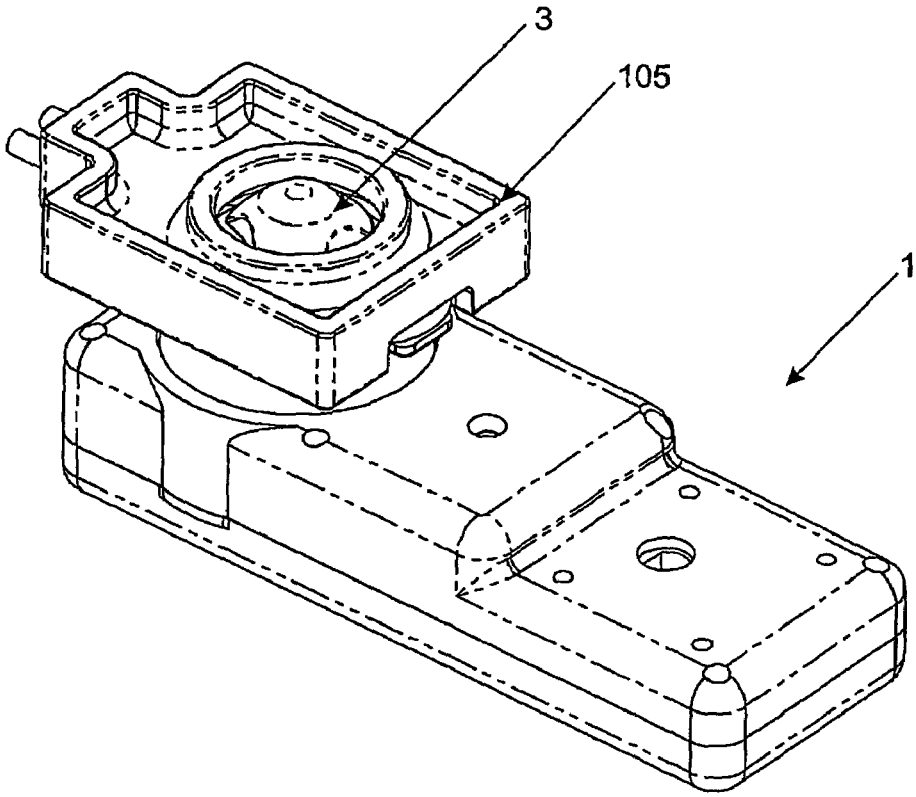
FIG. 1 is an overhead perspective view of a preferred embodiment peristaltic pump head in combination with a tube holder.
Figure 2:
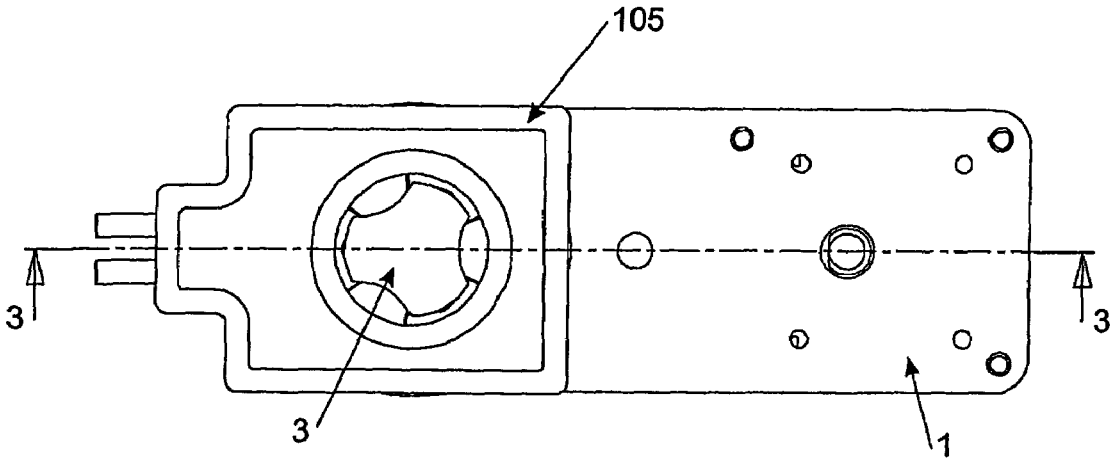
FIG. 2 is a plan view of the pump head and tube holder of FIG. 1.

With reference to FIG. 1, the peristaltic pump assembly has a main housing 1 carrying a rotor 3, which is received in a tube holder 105. The peristaltic pump head pumps fluid through a tube maintained in the tube holder 105, by the rotor compressing the tube and pushing fluid therethrough, this process known as occlusion. Two alternative preferred tube holders will be described below with reference to FIGS. 6-13.

Figure 3:
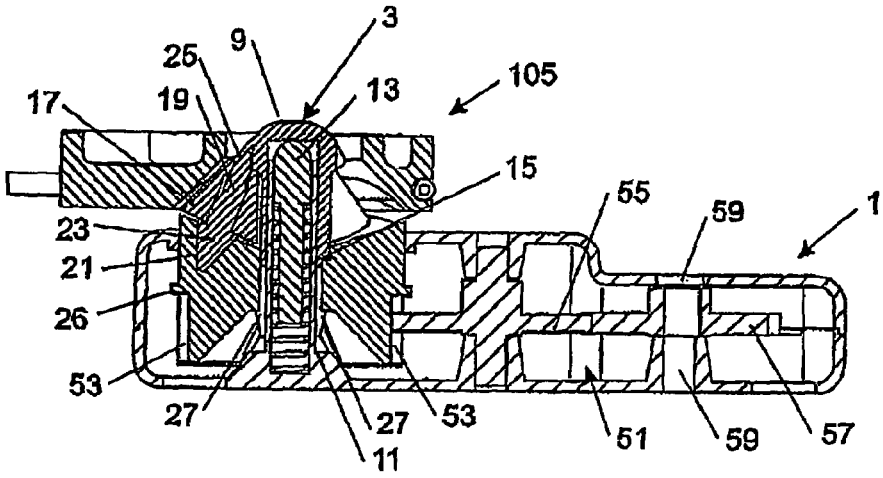
FIG. 3 is a side sectional view of the pump head and tube holder along line 3-3 of FIG. 2, in a pumping configuration.
Figure 4:
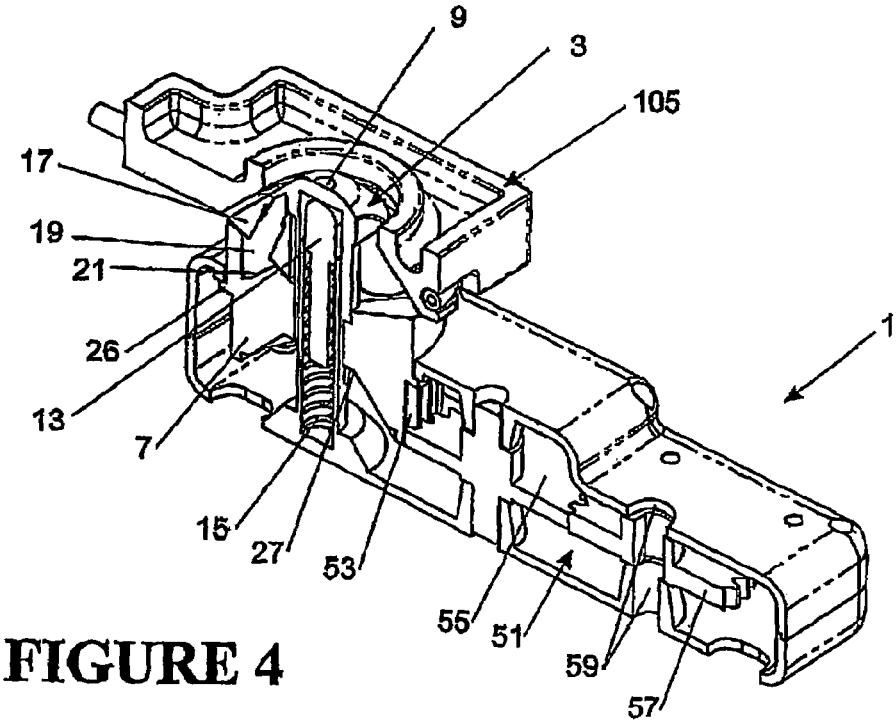
FIG. 4 is an overhead perspective sectional view of the pump head and tube holder along line 3-3 of FIG. 2, before the tube holder is moved into the pumping configuration.

As can be seen more clearly from the sectional views of FIG. 3 and 4, the preferred rotor 3 is tapered and more particularly is substantially conical in configuration, with its tapered end extending upwardly from the housing 1. The rotor 3 has a main body part 7 and a head part 9 interconnected with the main body part, which head part 9 is mounted for rotation on a boss 11 extending upwardly within the housing. As can be seen most clearly in FIG. 3, in side profile the head part 9 has a curved upper surface to enhance movement into the tube holder 105 when the components are brought together.

The boss 11 defines the axis of rotation of the rotor 3, and is substantially cylindrical or tubular and configured for receipt of a pusher 13. The head of the pusher 13 is biased against the underside of the head part 9 of the rotor by a biasing device 15, which is most preferably a compression spring coiled around a shaft of the pusher. The biasing device biases the rotor 3 towards its tapered head end, and therefore towards the tube holder 105 in the assembled configuration. A clearance is provided between the base of the pusher 13 and the base of the boss 11, and also between the base of the main body part 7 and the base of the housing 1. This enables the rotor 3 to move downwardly relative to the housing which allows it to automatically adjust within the tube holder as will be described.

A recess is provided in the rotor between the head part 9 and the main body part 7 for receipt of a number of rollers 17. In the preferred embodiment, three rollers are provided in an equally spaced configuration around the central axis of the rotor. However, it will be appreciated that the number of rollers can be varied as desired. The rollers 17 are substantially frustoconical in configuration, and are mounted for rotation on mounting members 19 which extend between the rotor main body part 7 and the head part 9. A corresponding number of inverted conical recesses 21 are provided in the main body part 7 of the rotor, for receipt of the enlarged conical bases 23 of the respective mounting members. Smaller recesses 25 are provided in the underside of the head part 9 for receipt of the upper ends of the mounting members.

Figure 5:
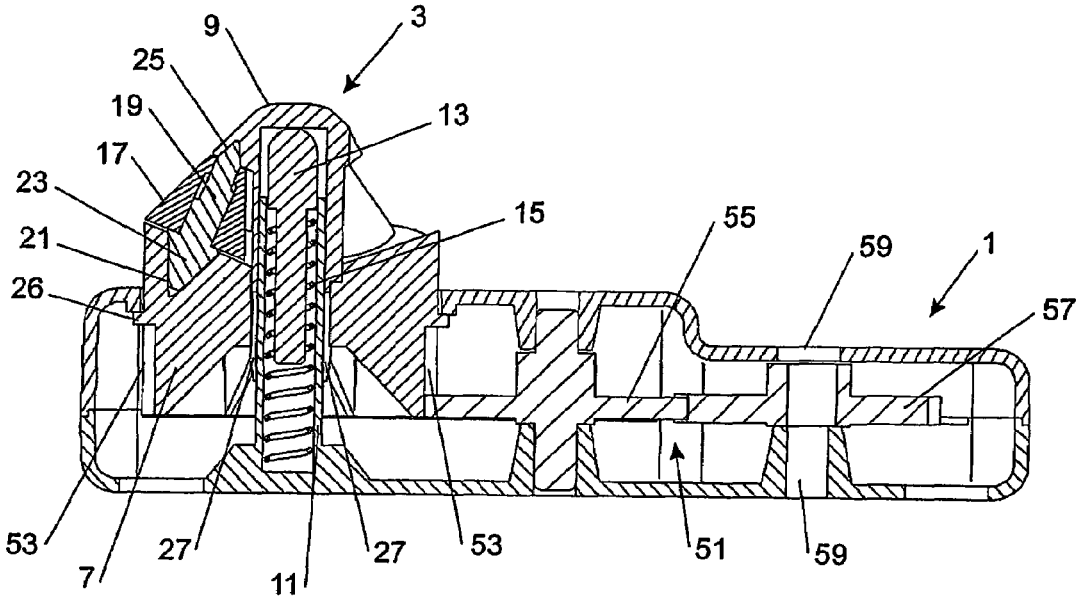
FIG. 5 is a side sectional view of the pump head along line 3-3 of FIG. 2, with the tube holder removed.
Figure 6:
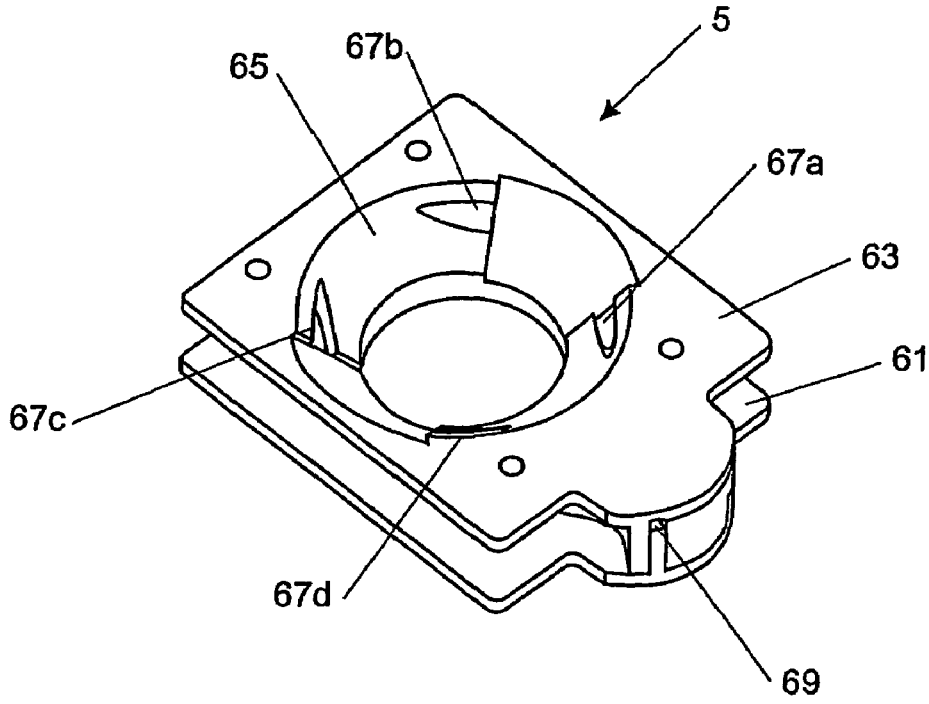
FIG. 6 is an overhead perspective view of a first preferred embodiment tube holder for use with the pump head of FIG. 1.
Figure 7:
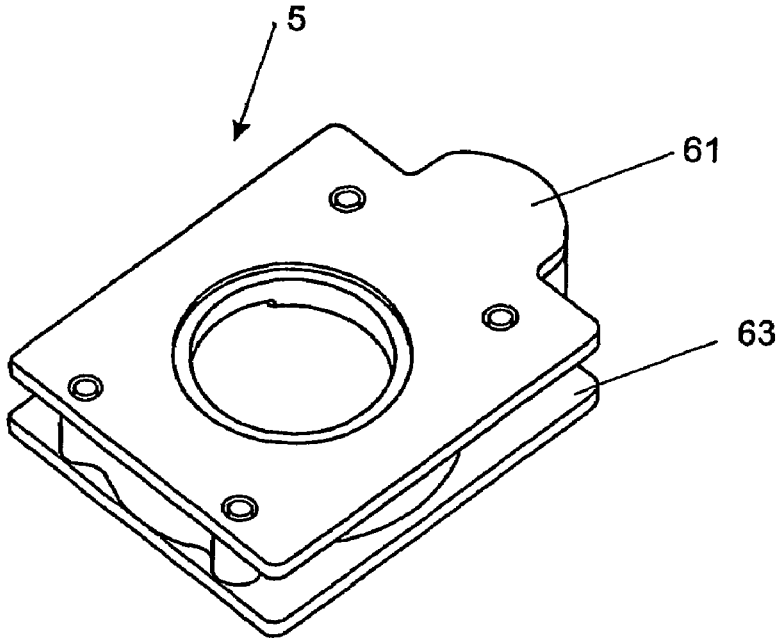
FIG. 7 is an underside perspective view of the tube holder of FIG. 6.
Figure 8:
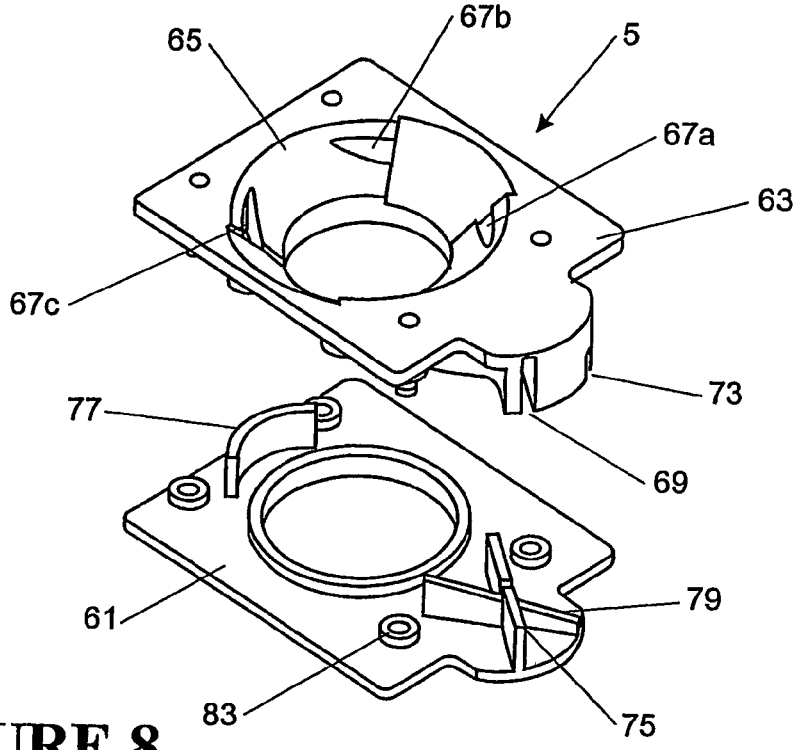
FIG. 8 is an exploded overhead perspective view of the tube holder of FIG. 6.

A stop, which in the embodiment shown is an annular lip 26, extends outwardly from the main body part 7 of the rotor, which defines the upper limit of travel of the rotor 3 within the housing 1. When the rotor is not in contact with the tube holder, the spring 15 will bias the rotor upwardly until the lip 26 engages the underside of the upper part of the housing 1 as shown in FIG. 5. When the tube race 5, 105 is brought into contact with the rotor (as will be described below) that will push the rotor downwardly against the bias of the spring, so the lip 26 no longer engages against the housing 1.

During assembly of the rotor 3, the mounting members 19 and rollers 17 are mounted on the rotor main body part 7, and the head part 9 is attached to the main body part 7 to maintain the rollers in position in the rotor. The mounting members 19 define the axes of rotation of the rollers 17 on the rotor, and it can be seen that these axes taper towards the head part 9 of the rotor. The included angles between the axes can be varied if desired.

A connector in the form of a pair of fingers 27 extend from the base of the head part 9 and are receivable in the central aperture of the main body part 7, so that the rotor can snap together, thereby sandwiching the mounting members 19 and the rollers 17 for rotation between the main body part 7 and the head part 9. The assembled rotor can then be inserted on the pusher 13 and spring within the boss 11, and the upper and lower housing 1 parts can be snapped together. Accordingly, the entire assembly of the housing 1, rotor 3 and gears 55, 57 can be assembled without the use of any bolts, screws or adhesives. It is further preferred that the engagement between the tube holder 5, 105 and rotor is achieved without any fasteners, so the entire assembly of the pump head and tube holder does not require the use of adhesives or separate fasteners.

A transmission mechanism generally indicated by reference numeral 51 is also provided in the housing for transmitting motive force to the rotor. In the embodiment shown, the outer perimeter of the main body part of the rotor includes a plurality of sprocket teeth 53. The teeth 53 are engaged with teeth on an intermediate gear 55, which in turn are engaged with the teeth of a drive gear 57. The sprocket teeth 53 around the base of the main body part are elongate and of sufficient length that they remain in engagement with the teeth of the intermediate gear 55 throughout the range of axial movement of the rotor within the housing 1. An aperture 59 is provided in the housing 1 and is aligned with the axis of rotation of the drive gear. A shaft can extend through the aperture 59 and engage the centre of the drive gear 57 to operably connect the drive gear to an electric motor (not shown) or similar. As shown in FIG. 4, coaxial apertures are provided in the housing 1 above and below the drive gear 57, so that the shaft could enter the housing either above or below as desired. Similarly, the housing could be inverted so that a shaft below the housing engages the drive gear 57 from the upper aperture (orientation relative to the drawing) if desired.

The relative numbers of teeth on the gears could be selected to provided a desired up-speed or down-speed of the rotor relative to the input speed as desired. More or less gears could be used. Alternatively, an alternative transmission such as pulleys and bands or gears and chains could be used. An electric servo motor could be positioned within the housing 1 rather than, or in addition to, using a transmission mechanism.

All of the components are most preferably made of a suitable polymer plastic material, such as acetyl, ABS or similar. Such a configuration is advantageous as it means the components can be easily fabricated in large numbers such as by injection moulding, the apparatus will be relatively light weight, and corrosion of the components will not occur. It may however, be desirable to fabricate the spring from a suitable metal such as spring steel to provide the desired spring characteristics.

As can be seen from FIGS. 1 to 4, a tube holder 105 is positioned above the rotor 3. That tube holder is described with reference to FIGS. 10 to 13. Another suitable tube holder 5 is shown in FIGS. 6 to 9. The tube holder has two parts, a base part 61 and a tube guide part 63 which together form a tube holder housing. The tube guide part 63 and base part 61 preferably snap together. The tube holder housing could be a unitary member if desired. The tube guide part 63 includes a tapered frustoconical recess 65 for receipt of the rotor 3 as shown in FIG. 3 for example. A number of apertures 67*a*, 67*b*,

67*c* and 67*d* are spaced around the recess and define a first tube inlet 67*a*, first tube outlet 67*b*, second tube inlet 67*c* and second tube outlet 67*d*. The apertures and the recess define a tube race within which the tube extends around the recess when it is inserted in the tube holder.

The tube race has a first race part defined by the first tube inlet 67*a*, the first tube outlet 67*b*, and the surface of the recess therebetween. The tube race has a second race part defined by the second tube inlet 67*c*, the second tube outlet 67*d*, and the surface of the recess therebetween.

Figure 9:
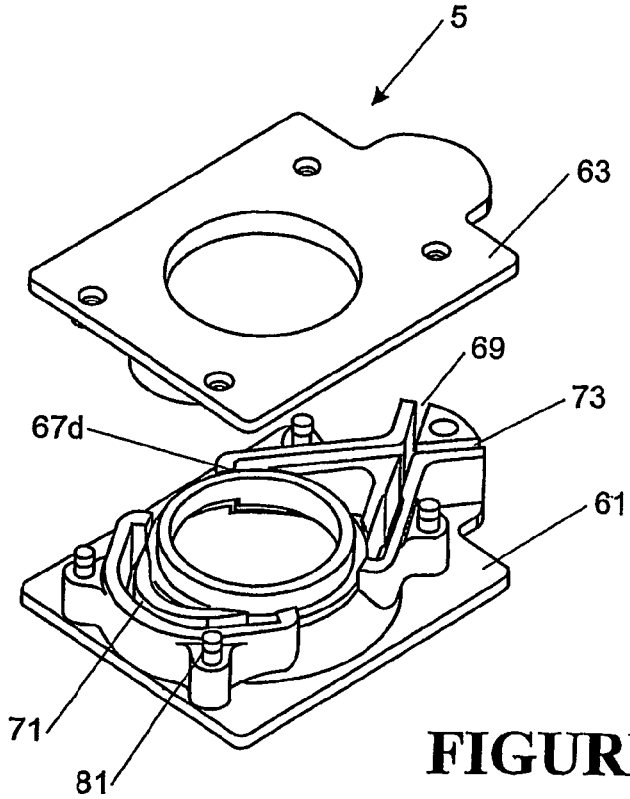
FIG. 9 is an exploded underside perspective view of the tube holder of FIG. 6.
Figure 10:
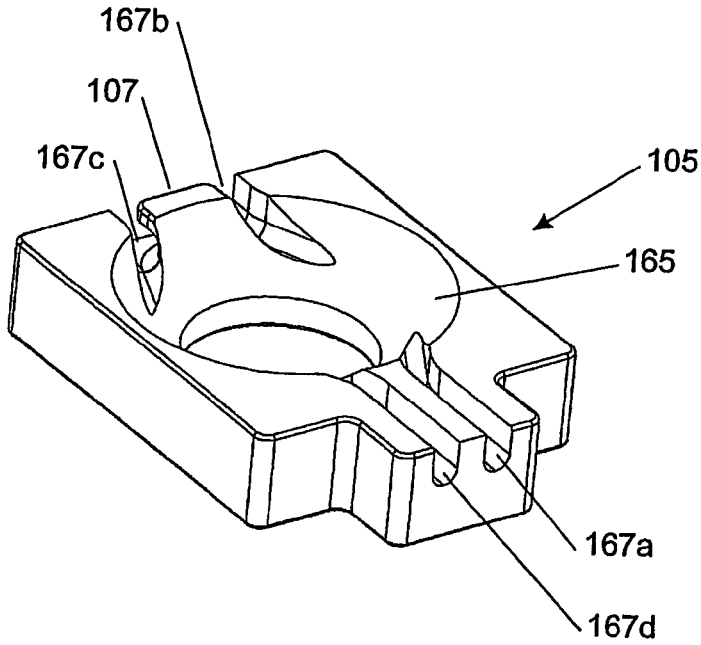
FIG. 10 is an overhead perspective view of a second preferred embodiment tube holder for use with the pump head of FIG. 1.
Figure 11:
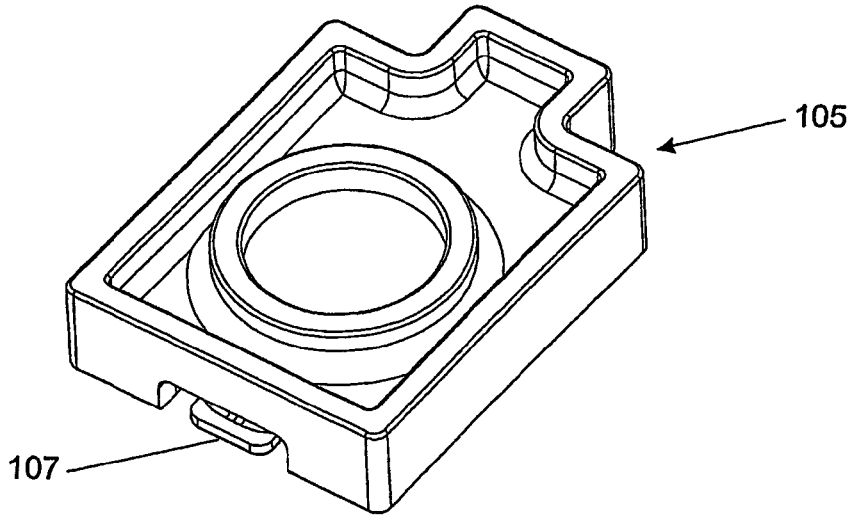
FIG. 11 is an underside perspective view of the tube holder of FIG. 10.

As can be seen from FIG. 9, the underside of the tube guide part 63 includes a plurality of channels aligned with the apertures. In use, and with reference to FIGS. 6 and 9, a tube is inserted into the housing through channel 69 and fed through the first tube inlet aperture 67*a*. The tube is then extended around the surface of the recess 65 as far as first tube outlet 67*b* and out through the first tube outlet 67*b*, around channel 71, back into the race through the second tube inlet 67*c*, around the surface of the recess 65 as far as second tube outlet 67*d*, out through the second tube outlet 67*d*, over the part of the tube extending inwardly through channel 69 and back out of the housing through channel 73. It will be appreciated that the tube could be inserted through the housing in the other direction, ie in through channel 73 and out through channel 69 if desired.

A transverse hole (not shown) may be provided at the intersection of channels 69 and 73, the hole extending from top to bottom of the tube holder. The edges where the hole meets the channels 69 to 73 would provide a relatively sharp edge against which the tube parts would engage to assist in gripping the tube and maintaining it in position in the tube holder.

The portions of the tube located against the surface of the recess 65 are occluded by the rollers 17 of the rotor 3 when the tube holder and rotor are in the configuration shown in FIG. 3 and the rotor is rotated. The surfaces of the recess 65 against which the tube is seated provide occluding surfaces, with the tube being compressed between the rollers 17 and those surfaces.

By having the tube exit and re-enter the tube race as described above, movement of the tube in the axial direction of the rotor during use is inhibited, as the edges of the apertures 67*a*, 67*b*, 67*c* and 67*d* prevent significant axial movement of the tube. Further, as the rollers only act against discrete parts of the tube, that also serves to minimise longitudinal movement of the tube as the rotor rotates.

The rollers 17 on the rotor and the tube holder are configured so that part of the tube is always compressed under at least one roller, to prevent leaking of fluid from the reservoir or backflow into the reservoir.

To provide additional stability to the tube in the holder, the inside of the tube holder base 61 includes a number of shaped projections 75, 77 and 79 which are located in channels 69, 71 and 73 respectively when the holder base part 61 and the guide part 63 are brought together. The projections may be sized such that there is limited clearance between the ends of the projections and the bases of the respective channels when the tube holder base part and guide parts are assembled, so that the tube is slightly compressed therebetween (such a configuration being shown in FIG. 6). In this embodiment, the tube would need to be threaded into the guide part before the guide part is brought into contact with the base part. Corresponding protrusions 81 and apertures 83 are provided in the base part and the guide part, which are an interference or snap fit to maintain the base part and the guide part in the assembled configuration.

However, it is not essential that the tube be slightly compressed between the base and guide parts, as it can be sufficiently held simply by exiting and re-entering the tube race. In the embodiment in which the tube is not compressed between the base and guide parts, those components can be assembled before the tube is fed into the housing.

FIGS. 10 to 13 show an alternative preferred tube holder 105. This tube holder is a unitary component, and again includes a tapered frustoconical recess 165 for receipt of the rotor 3 as shown in FIG. 3. Rather than using apertures to define tube inlets and outlets, they are defined by a number of grooves. The grooves define a first tube inlet 167*a*, a first tube outlet 167*b*, a second tube inlet 167*c* and a second tube outlet 167*d*. The grooves and recess define a tube race within which the tube extends around the recess when it is inserted in the tube holder.

The tube race has a first race part defined by the first tube inlet 167*a*, the first tube outlet 167*b*, and the surface of the recess 165 therebetween. The tube race has a second race part defined by the second tube inlet 167*c*, the second tube outlet 167*d*, and the surface of the recess 165 therebetween.

The channels forming the first tube inlet 167*a* and second tube outlet 167*d* could cross, in a similar manner to channels 69 and 73 of the embodiments of FIGS. 6 to 9. Additionally or alternatively, the channels forming the tube inlets and outlets could include features along their walls to improve grip on the tube. For example, teeth or projections (not shown) could be present along the walls of the channels to assist in gripping the tube.

An outwardly extending projection or lip 107 is situated between the first tube outlet 167*b* and the second tube inlet 167*c*. The lip 107 is located above the level of the first tube outlet 167*b* and the second tube inlet 167*c* (in the orientation of FIG. 9), and assists in maintaining the tube in the tube holder. The lip could include a downwardly extending (in the orientation shown in FIG. 10) projection at its distal end to assist in maintaining the tube in the tube holder.

Figure 12:
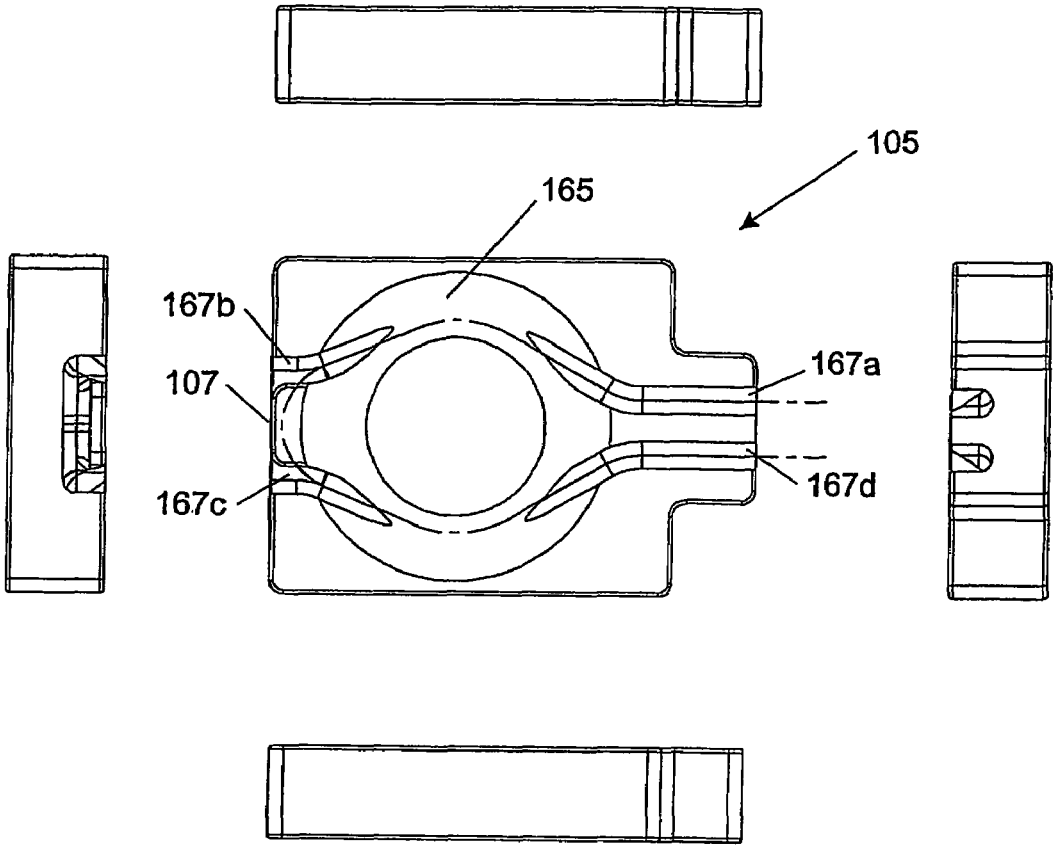
FIG. 12 is a plan view of the tube holder of FIG. 10.
Figure 13:
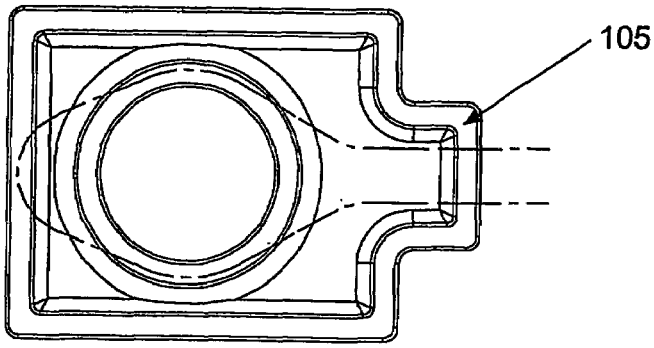
FIG. 13 is an underside view of the tube holder of FIG. 10.

To load the tube into the tube holder, it is provided in a substantially U-shaped configuration and is moved in a direction substantially orthogonal to the tube race (ie downwardly in the orientation of FIG. 10) such that the tube extends in through the first tube inlet 167*a*, around the surface of the recess 165, out through the second tube outlet 167*b*, in through the second tube inlet 167*c*, around the surface of the recess 165, and out through the second tube outlet 167*d*, as shown in phantom in FIG. 12. This can be achieved in a single orthogonal movement, and can be performed manually or by a machine.

The tube can then be pulled in the direction of first tube inlet 167*a* and second tube outlet 167*d* such that the base of the U-shape is located under the lip or projection 107. A wider lip or projection 107 could be provided, and the first tube outlet 167*b* and second tube inlet 167*c* could extend more towards the corners of the tube holder than shown in FIG. 12 (in more of a "V" shape), to provide a longer curved portion under the lip or projection 107 around which the tube extends when installed, to thereby assist in maintaining the tube in position in the tube holder.

Again by virtue of the tube exiting and re-entering the tube race, movement of the tube therein is inhibited. If desired, to provide additional stability to the tube in the tube race, the base of the grooves could be slightly enlarged relative to the upper portions of the grooves so that the tube is a snap fit into the grooves.

The portions of the tube extending around the recess 165 are occluded by the rollers 17 of the rotor 3 when the tube holder and rotor are in the configuration shown in FIG. 3 as the rotor is rotated.

When the tube holder 105 is located in position on the pump head housing 1, the outer edges of the grooves 167*a-d* will be located against the surface of the housing 1.

One end of the tube will typically be fluidly connected to a source of fluid, and the other end of the tube will typically be fluidly connected to an apparatus for delivery of the fluid.

Either type of tube holder 5, 105 can be used in with peristaltic pump head. In the assembled configuration of the pump head and the tube holder, the tube holder 5, 105 may be floating relative to the pump head housing 1, i.e. limited movement transverse to the axial direction of the rotor will be provided, or may be fixed relative to the housing. Limited axial movement of the tube holder can also be provided, which is compensated for by the biased pump head. For example, a tube holder carrier (not shown) may be provided containing a recess within which the tube holder can be placed, with limited axial and transverse movement of the tube holder relative to the carrier. The components can then be brought together so that the rotor extends through the recess in the tube holder, to pump fluid through a tube in the tube holder. The housing 1 could be attached to the carrier so that no movement therebetween (but there could still be floating movement of the tube holder), but it is preferred that some floating movement is provided between the housing 1 and the carrier, to accommodate misalignment between the rotor and the tube holder.

By virtue of the transverse floating of the tube holder 5, 105 and the axial bias of the rotor 3, the pump head will be self aligning and self adjusting. The biased tapered rotor 3 will move the tube holder 5, 105 transversely if necessary so that it is aligned with the centre of the recess 65, 165. Further, the rotor will automatically move axially a sufficient distance that the rollers are located against the tube in the tube holder with a desired force determined by the spring characteristics. Therefore, the pressure applied to the tube by the rotor will be substantially constant. That would also occur without any transverse floating between the tube holder and the pump head.

It is preferred that the pump head could be operable in a forward or rearward direction, to either dispense or suck fluid.

Figure 14:
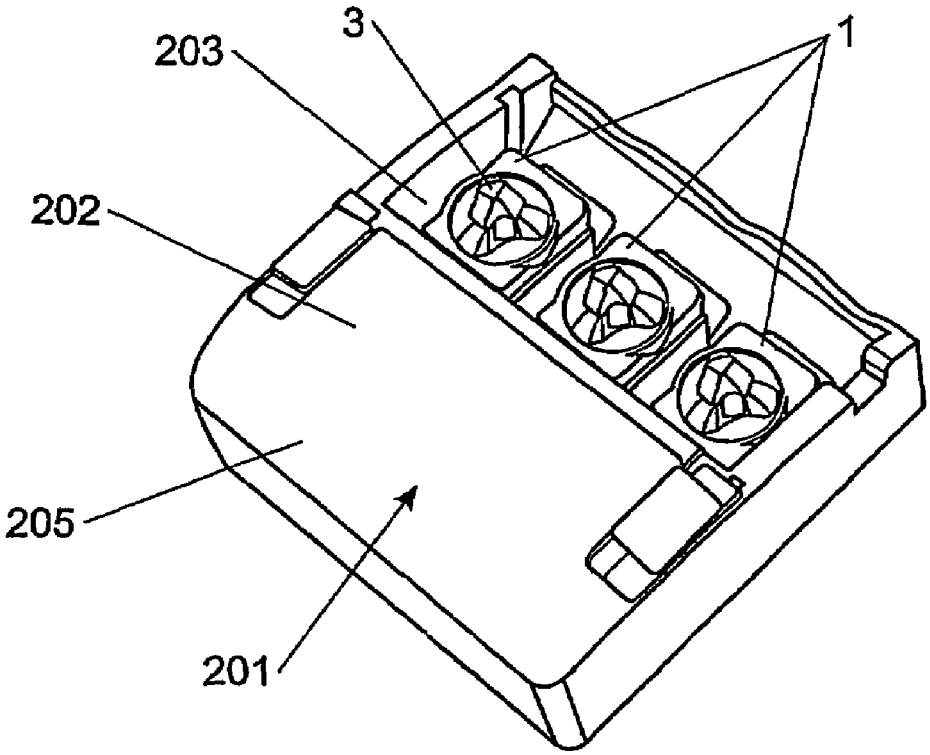
FIG. 14 is an overhead perspective view of a pump assembly including three pump heads of FIGS. 1 to 4.

The tube holders are preferably made from a polymer plastics material, such as acetyl, ABS or similar, and may be fabricated by injection moulding for example. The pump head can be made to a small size, with the dimensions of the main housing 1 being about 68 mm×25 mm×15 mm (at the deepest point shown), and the dimensions of the tube holder being about 30 mm×25 mm×7 mm for example. However, the pump head is fully scalable, and could be used to make much larger pumps. In larger pumps, the tube holder could be modified to have a greater number of race parts, ie the tube could be woven in and out of the housing a greater number of times than described above. FIG. 14 shows a pump assembly generally indicated by reference numeral 201. The pump assembly includes a main housing 202 which includes a recess 203 containing three of the pump heads 1 described with respect to FIGS. 1 to 4. While three pump heads 1 are shown in the Figure, more or less pump heads could be provided if desired. The pump heads are positioned so that the rotors 3 are positioned in the recess 203, which is configured to receive a tube holder as will be described below.

Although not shown in the Figure, the main housing also includes an interior chamber which is covered by a cover 205. The chamber preferably houses a drive mechanism or mechanisms such a number of servo motors and a microprocessor for controlling the drive mechanism(s). The housings of the pump heads 1 extend into the interior chamber and the drive mechanism may be operably connected to the transmission mechanism via a shaft extending through the aperture 59 in each pump head housing for example. It is preferred that the pump heads 1 are independently operable. The pump head housings are preferably fixed in the pump assembly main housing 202 by fasteners or the like, so that they cannot move relative to the pump assembly main housing 202.

Figure 15:
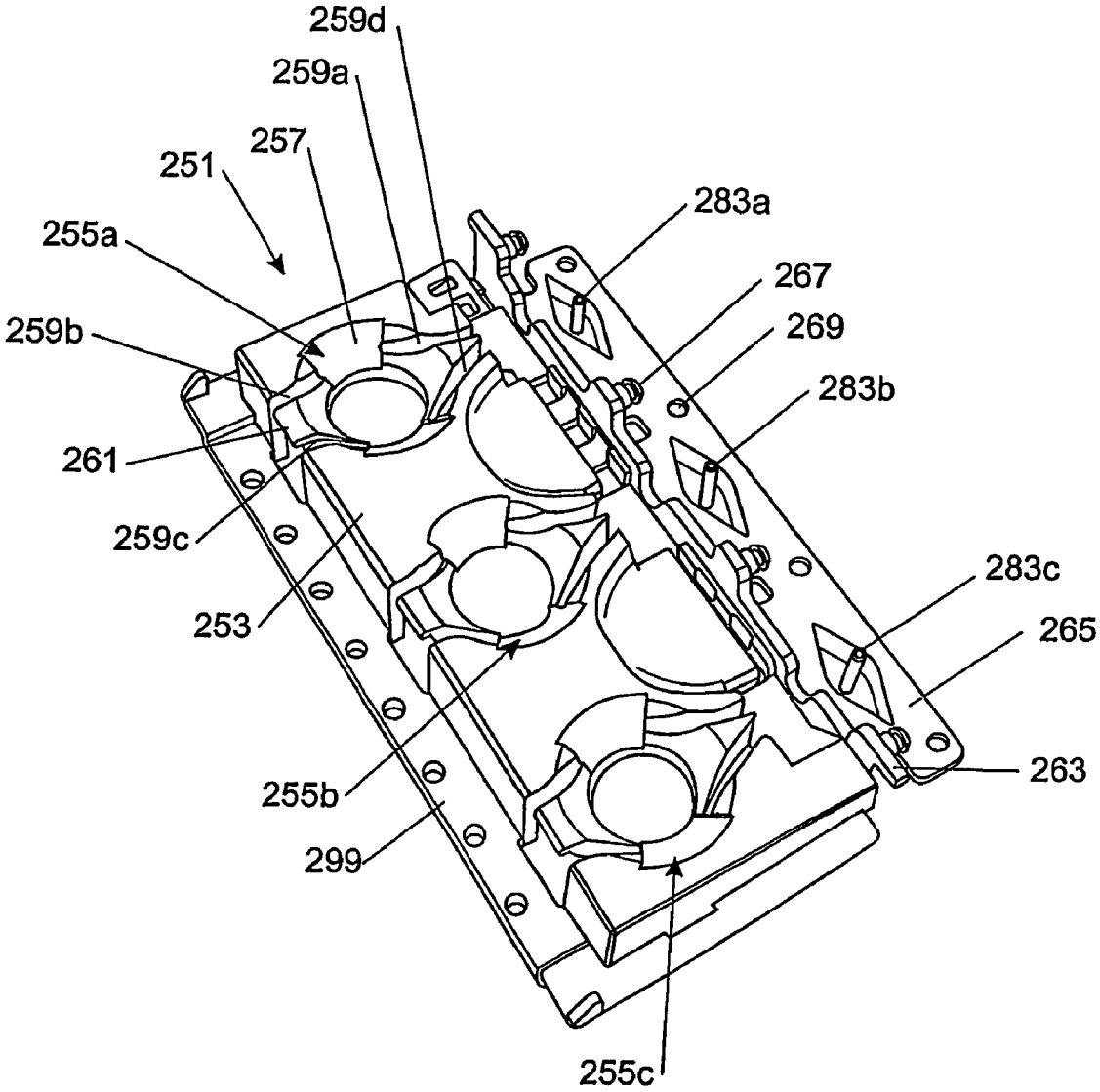
FIG. 15 is an overhead perspective view of a preferred embodiment tube holder for use with the pump assembly of FIG. 14.

FIG. 15 shows a preferred embodiment tube holder generally indicated by reference numeral 251, for use with the pump assembly of FIG. 15. The tube holder 251 includes a main body part 253 which includes three tube holding portions 255*a-c*. The number of tube holding portions will be selected to correspond with the number of pump heads 1 in the pump assembly main housing 202.

Each of the tube holding portions 255*a-c* has generally the same configuration as the tube holder of FIGS. 10 to 13, and includes a tapered frustoconical recess 257 for receipt of the rotor 3 of the respective pump head 1. Each tube race is defined by a first tube inlet 259*a*, a first tube outlet 259*b*, a second tube inlet 259*c* and a second tube outlet 259*d*. The tube race has a first race part defined by the first tube inlet 259*a*, the first tube outlet 259*b*, and the surface of the recess 257 therebetween. The tube race has a second race part defined by the second tube inlet 259*c*, the second tube outlet 259*d*, and the surface of the recess therebetween.

An outwardly extending projection or lip 261 is situated between the first tube outlet 259*b* and the second tube inlet 259*c*. The lip 261 is located above the level of the first tube outlet 259*b* and the second tube inlet 259*c* (in the orientation of FIG. 15), and assists in maintaining the tube in the tube holder.

The tube holder body 253 includes a flange 263, and a hinged connecting member 265. The hinged connecting member 265 is movable from the position shown in FIG. 15 wherein it is pivoted away from the flange 263 to a position shown in FIG. 17 wherein it is in contact with the flange 263. The flange 263 includes engagement projections 267 with enlarged heads for engaging in recesses 269 in the connecting member 265 when it is in the position shown in FIG. 17.

Figure 16:
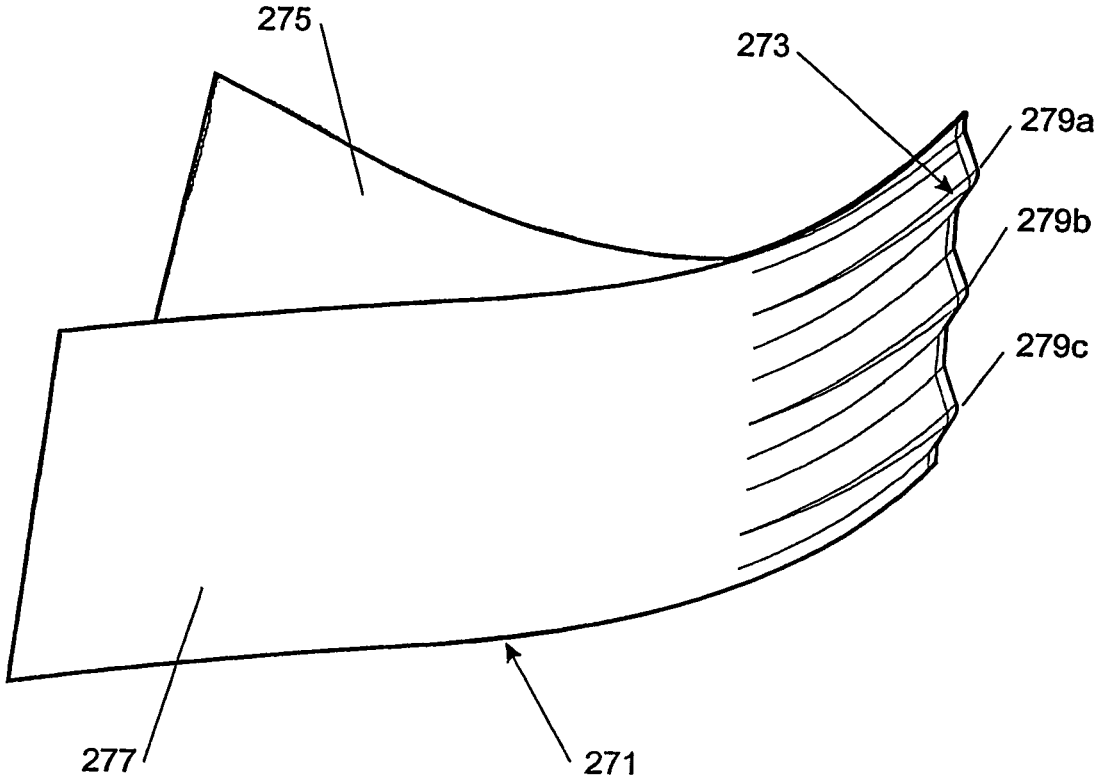
FIG. 16 is a perspective view of a sachet which will be connected to the tube holder of FIG. 15.

The hinged connecting member 265 is connected to a flexible container in the form of a sachet for containing fluid to be delivered by the pump. A suitable sachet 271 is shown in FIG. 16. In the embodiment shown, the sachet 271 includes a neck portion 273 and two reservoir portions 275, 277 in a Y-configuration. It has been found that by using two reservoir portions 275, 277 in the configuration shown, a lower profile can be achieved while still providing the desired storage volume for fluid to be administered by the pump.

The neck portion 273 is formed with three enlarged apertures 279*a-c*, configured to receive corresponding mounting bosses 281*a-c* on the hinged connecting member 265 of the tube holder 251. The sachet 271 is connected to the tube holder 251 by inserting the mounting bosses 281*a-c* into respective enlarged apertures 279*a-c*. The sachet 271 and tube holder 251 may be maintained in connection by adhering the bosses 281*a-c* in the enlarged apertures with an adhesive or similar, or by plastic welding the components together for example. Suitable materials for the sachet include, but are not limited to, a flexible polymer plastic or foil. The tube holder is preferably made from a polymer plastic.

Figure 17:
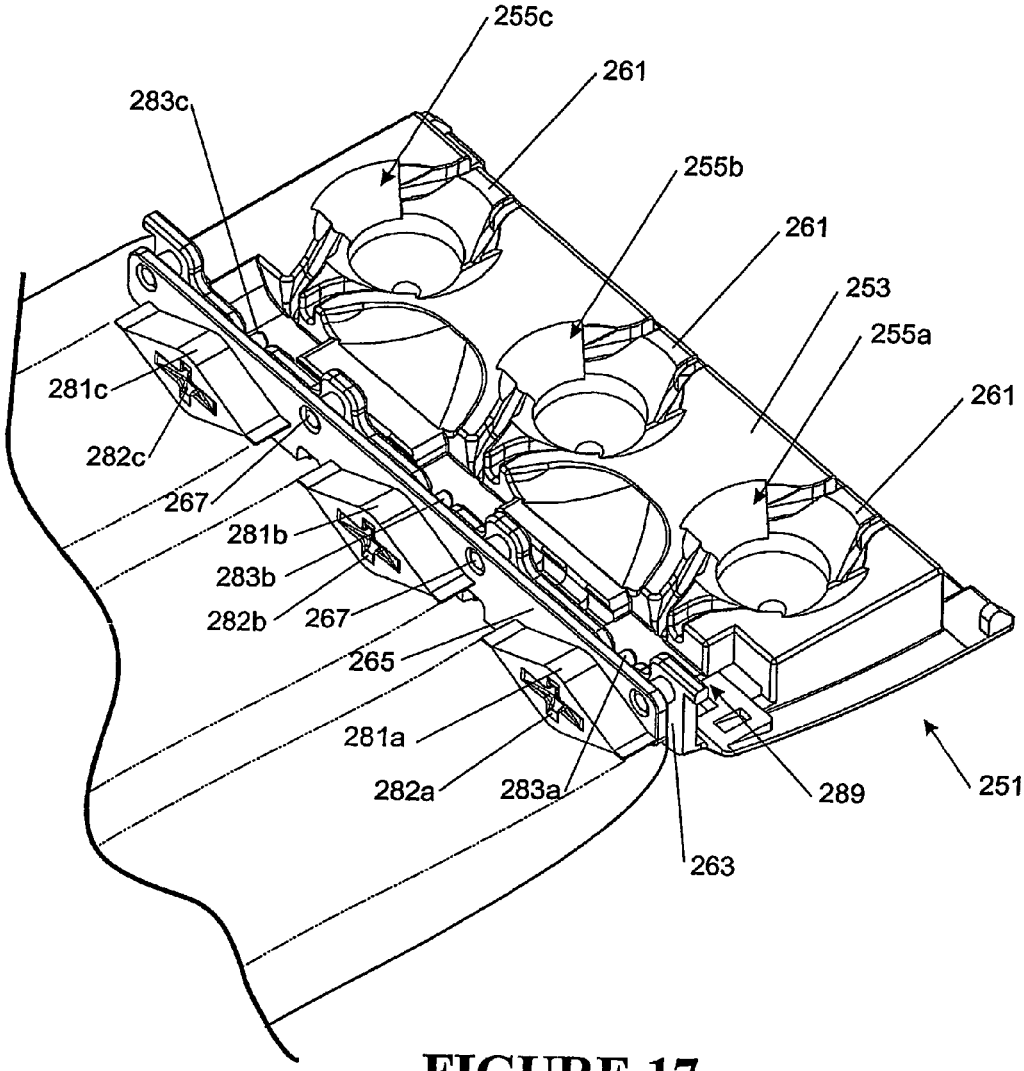
FIG. 17 is an overhead perspective view of the tube holder of FIG. 15 connected to a flexible container in the form of a sachet.
Figure 21:
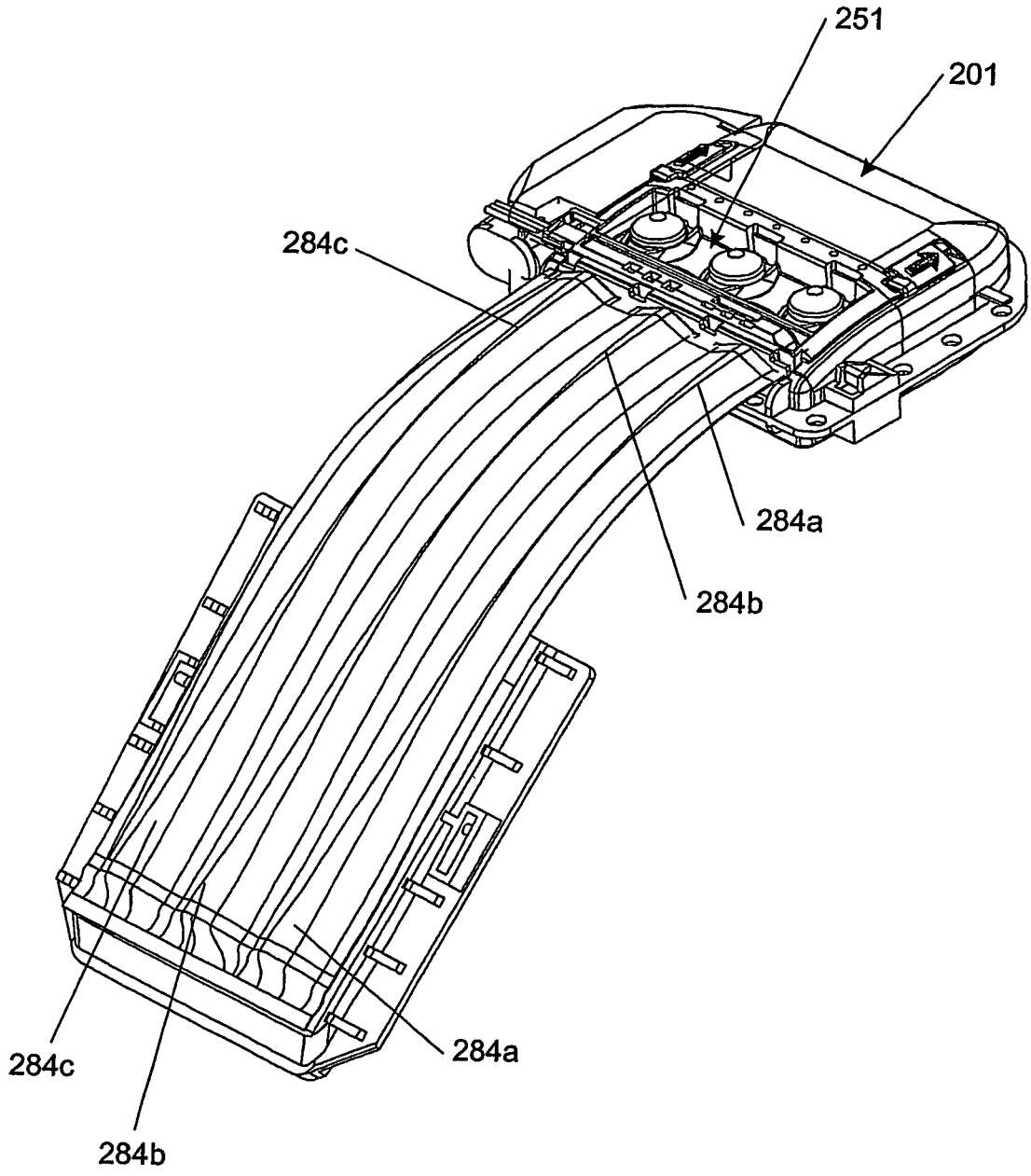
FIG. 21 shows the sachet and tube holder of FIG. 19 connected to the pump assembly of FIG. 14.

Apertures 282*a-c* extend through the mounting bosses 281*a-c* of the tube holder, and into corresponding spigots 283*a-c* which extend towards the tube holding portions 255*a-c* when the connecting member 265 is in the position shown in FIG. 17. The apertures are in fluid communication with the interior of the sachet 271*a*. This sachet differs as the interior of the sachet is divided into the same number of independent fluid chambers as there are enlarged apertures 279*a-c* in the neck. This is shown in more detail in FIGS. 18 and 21. In the assembled sachet/tube holder, each mounting boss 281*a-c* extends into a respective fluid passage 284*a-c*, each of which is in fluid communication with a respective fluid chamber 285*a-c* (FIG. 21). The fluid passages 284*a-c* are sealed from one another by webs 286. It is not necessary that the sachet is divided into separate fluid chambers, and a single fluid chamber could be provided. However, by providing independent fluid chambers, the pump assembly and sachet/tube holder can be used to selectively deliver different fluids from a single sachet.

Figure 18:
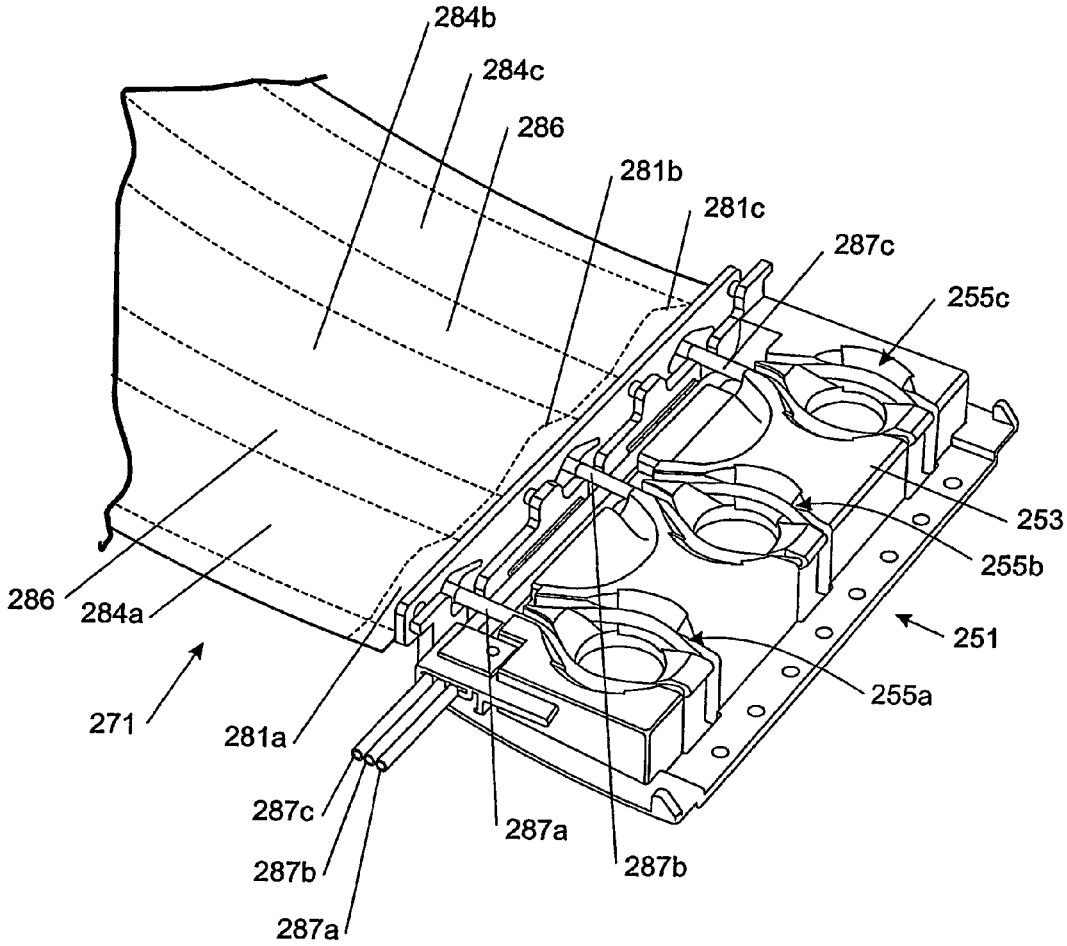
FIG. 18 is an overhead perspective view of the tube holder of FIG. 17, with tubes fed around the tube holding portions.
Figure 19:
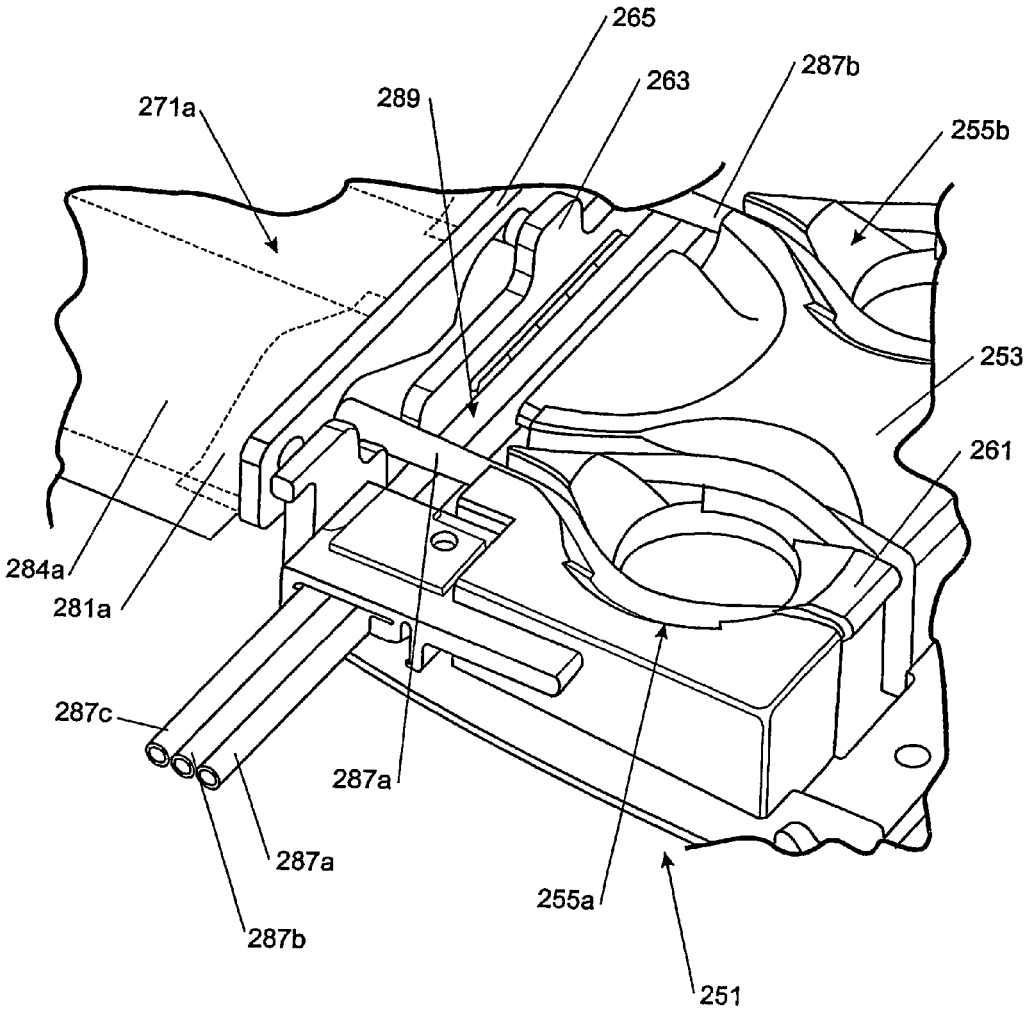
FIG. 19 is an overhead perspective detail view showing the interconnection between one of the tubes and the sachet.

In use, tubes are connected to the spigots and installed in the tube holding portions 255*a-c*. More particularly, when the hinged attachment member 265 is in the position shown in FIG. 15 (and connected to a sachet), a tube 287*a-c* is connected to each spigot 283*a-c*. The tubes are preferably an interference fit on the respective tube to assist in maintaining the connection between the tubes and the spigots. The tubes 287*a-c* are held in a substantially U-shaped configuration, and the hinged connecting member 265 is moved to the position shown in FIG. 17. The tubes are moved so that they extend around the respective tube holding portions 255*a-c* in a similar manner as that described above with reference to FIGS. 9 to 13. The free ends of the tubes can then be pulled so that the tubes are located under the lips 261 to assist in maintaining the tubes in the tube holding portions 255*a-c*. The free ends of the tubes 287*a-c* extend through a channel 289 and out the side of the housing 253 as shown in FIGS. 18 and 19.

Figure 20:
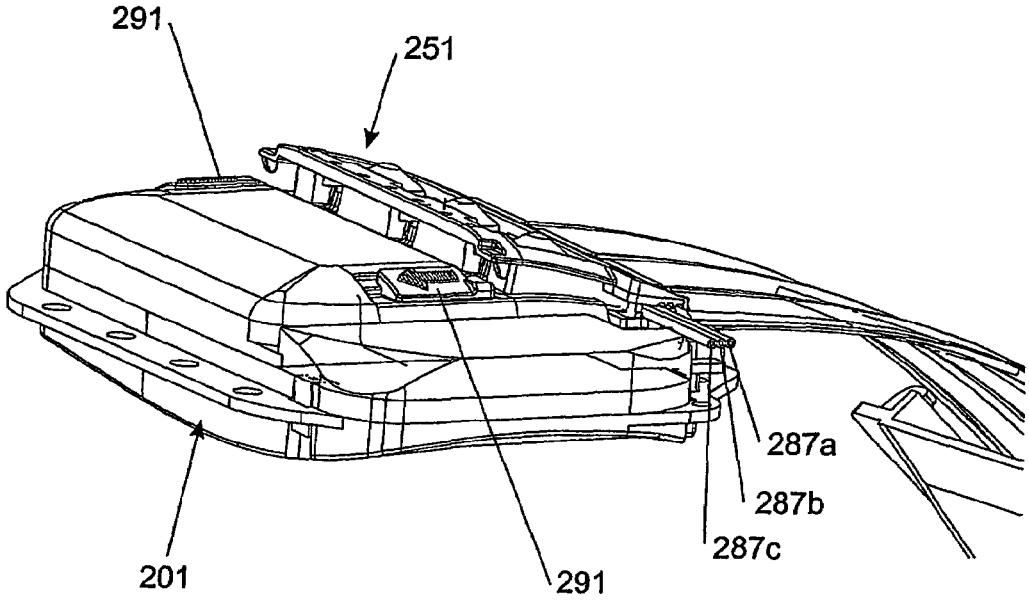
FIG. 20 shows the sachet and tube holder of FIG. 19 being brought into connection with the pump assembly of FIG. 14.

The installation of the tube holder 251 in the pump assembly 201 is shown in FIG. 20. In particular, the tube holder 251 and sachet 271 are inverted from the orientation shown in FIGS. 17 to 19, and the tube holder body is inserted into the recess 203 in the pump housing 202. One edge of the tube holder 251 is inserted first, and the opposite edge is pushed downwardly to the recess. When the tube holder is in position in the recess 203 of the pump housing 202, the tapered rotors 3 are positioned in the recesses 257 of the tube holding portions 255*a-c* and engage the tubes 287*a-c* so that actuation of the pump heads causes the tubes to be occluded, and fluid delivered from the reservoirs through the tubes. The tubes are preferably resiliently flexible so that they return substantially to their original configuration after being compressed by the rollers of the rotors during occlusion, meaning that as they return to their original shape following occlusion. They will suck fluid through the tubes behind the rollers, enabling the flexible sachet to be used in a non-overhead configuration. For example, the sachet could be positioned in use to be substantially horizontal.

It is preferred that the pump heads could be operable in a forward or rearward direction, to either dispense or suck fluid.

A pair of biased clips 291 maintain the tube holder in position in the pump housing by engaging a lip 299 of the tube holder. To release the tube holder, the clips are moved in the direction of arrow A in FIG. 20, and the tube holder can be lifted out of the recess 203. Once empty, the sachet and tube holder can be disposed of, and a further sachet and tube holder can be connected to the pump housing in the manner described above.

Figure 22:
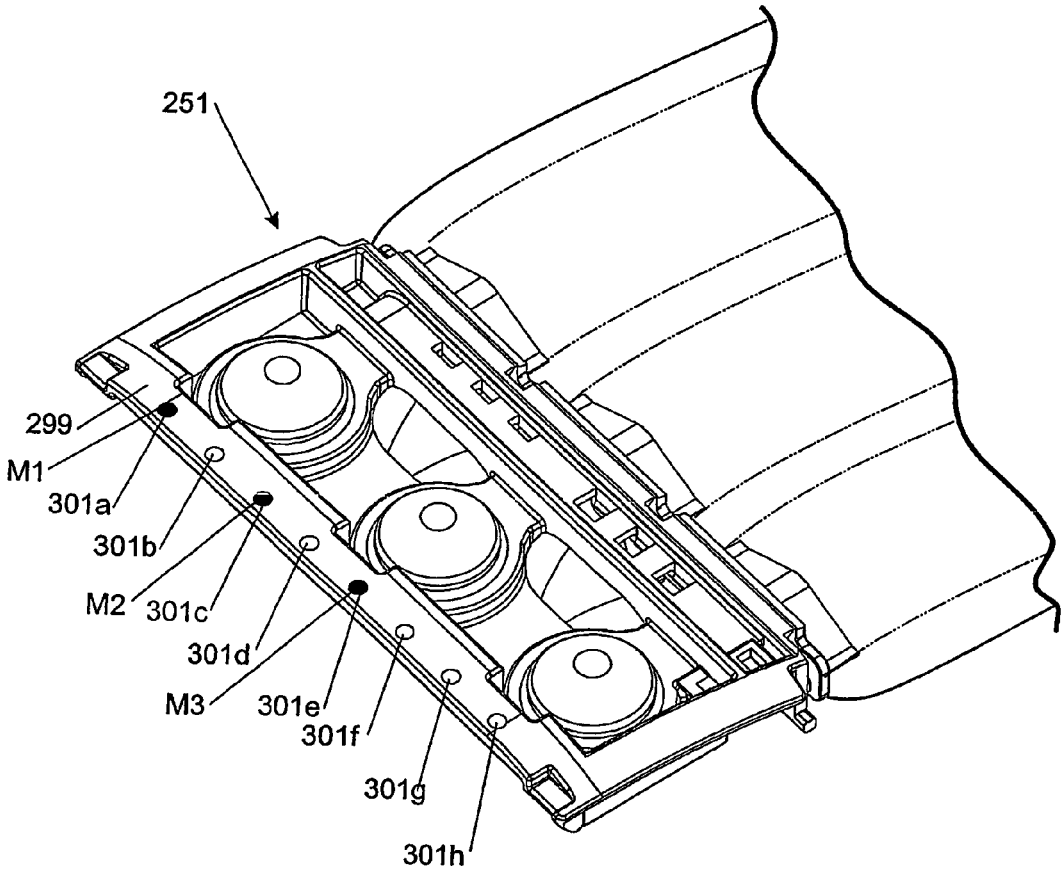
FIG. 22 shows the sachet and tube holder of FIG. 17, including magnets forming a coding system.
Figure 23:
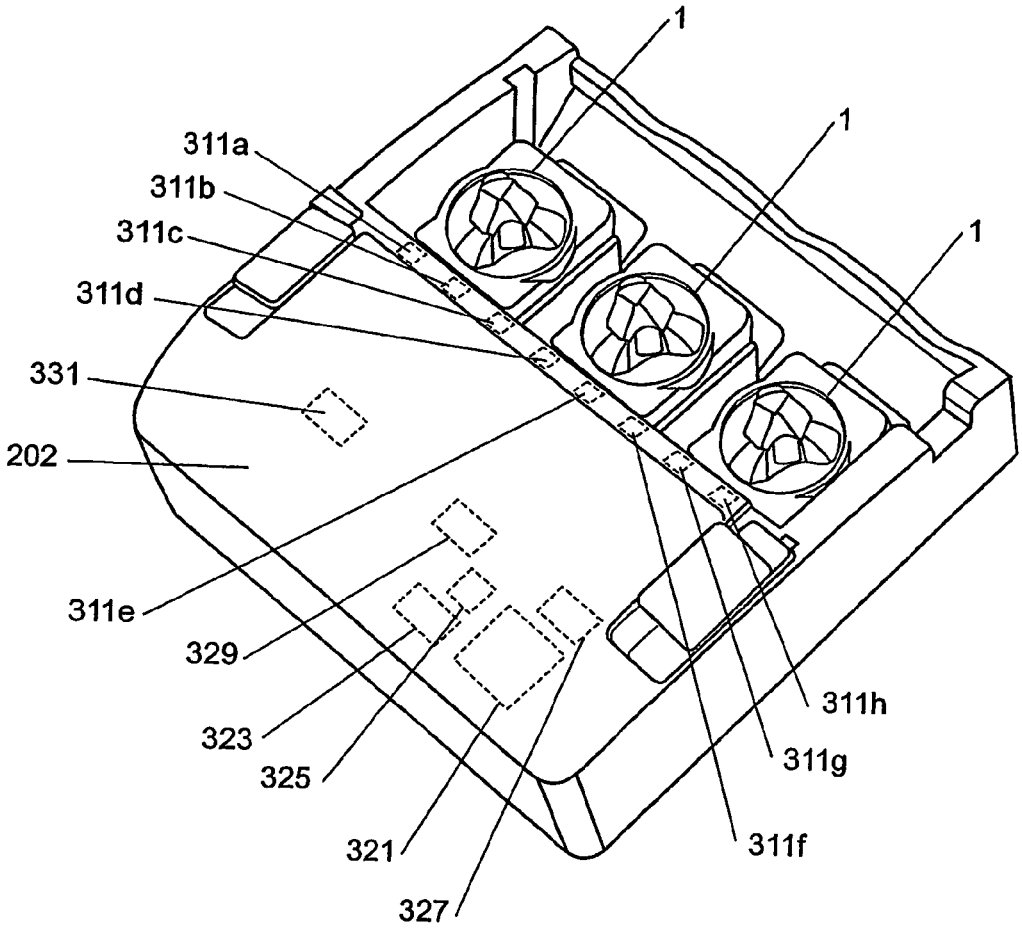
FIG. 23 schematically shows a pump assembly configured to read the coding system of the tube holder of FIG. 22.

FIGS. 22 and 23 show a coding system for coding the sachet described above with reference to FIGS. 15 to 21. As shown in FIG. 22, the lip 299 of the tube holder 251 has a plurality of magnet mounting sites 301*a*-301*h* for receipt of ferromagnetic inserts. In the form shown, the magnet mounting sites are in the form of apertures. The preferred embodiment is shown as having eight magnet mounting sites, but more or less sites could be provided as desired. By selectively placing magnets in one or more of the sites, a binary code is provided which can be read by suitable sensors to determine the contents of the sachet, in a manner to be described below. In the embodiment shown, three magnets $M_1$, $M_2$, $M_3$ are located in the apertures 301*a*, 301*c* and 301*e*.

Referring now to FIG. 23, a corresponding number of sensors 311*a*-311*h* are provided on or in the pump assembly main housing 202, in positions substantially corresponding to the positions of the magnet mounting sites 301*a*-301*h* when the tube holder is connected to the housing in the manner described above with reference to FIG. 21. The magnet sensors can be provided either on an upper surface of the housing or just below the surface, so that each sensor can sense when a magnet is present in the corresponding position on the tube holder. As will be readily apparent, the magnets could be provided in other positions on the tube holder than on the lip 299, and the magnet sensors could be positioned in other corresponding positions on or in the pump assembly housing. Further, the magnets could be provided on the sachet itself, rather than the tube holder. The preferred type of magnet sensors are Hall Effect sensors.

When the tube holder is inserted into the pump assembly main housing and seated in its proper position, each sensor will sense whether there is a magnet present at a respective magnet mounting site on the tube holder. By using the sensors and magnets in the configuration shown, the sensing can occur when the tube holder is stationary relative to the pump assembly. For example, when the tube holder of FIG. 23 is connected to the pump assembly main housing, sensors 311*a*, 311*c* and 311*e* will sense that magnets are present in locations 301*a*, 301*c* and 301*e* respectively, and the remaining sensors will not detect any magnets. Sensors 301*a*, 301*c* and 301*e* will then signal a microprocessor 321. The microprocessor will determine from those signals the numbers and positions of the magnets, and will then access a memory 323 to determine from the code the substance(s) in the sachet (and, if more than one substance is present, which pump to actuate to deliver that substance). If the code is recognised, the processor activates software routines associated with the code (and thereby the particular sachet contents). The software routine may determine when the pumps should be actuated, for how long, and in which combination for example. Based on the software, the microprocessor will signal a controller 325, which will selectively operate servo motors 327, 329 and 331. If the code is not recognized, the pump will not operate, and will issue a warning. Sachets containing different substances will be coded with different combinations of magnets, and the combinations will be stored in the memory 323 along with suitable software routines. That way, the pump assembly will recognise the contents of a sachet and operate accordingly.

It will be appreciated that the magnetic inserts provide a number of magnetic areas for detection by the sensors on the pump assembly. Other means of providing magnetic or magnetisable areas could be used. For example, one or more strips of material could be provided on the sachet, with discrete parts of the strip(s) being magnetised as desired. Alternatively, a number of inserts of a material which exhibits no magnetic properties until magnetised, could be used. For example, Beryllium inserts could be used, some or all of which are magnetised as required to provide the binary code. As another example, the strip(s) of material could include a number of linked Beryllium magnets, some or all of which are magnetised as required.

When magnetic inserts are used, they would generally be inserted to code the sachet when it is filled with one or more substances by a supplier. Alternatively, the strip(s) of material or the items of material which require magnetising could be provided during manufacture of the sachet/tube holder, eg could be moulded into the tube holder, and then magnetised as required when the sachet is filled with one or more substances. Alternatively, the sachet/tube holder could be pre-coded during manufacture for use with a particular substance or substances.

The preferred tube holder and peristaltic pump head described above have a number of advantages. In particular, the tube holders in which the tubes exit and re-enter the tube race maintain the tubes in a desired position in the race during a pumping operation. Further, by virtue of the tube holder being mounted to float transversely relative to the tapered rotor, the rotor and tube race are self-aligning. By axially biasing the rotor, the tube holder and the rotor as also self-adjusting to maintain the desired pressure on a tube in the tube race.

The above describes preferred embodiments of the present invention, and modifications may be made thereto without departing from the scope of the invention.

For example, it is not essential that the rotor is axially biased, nor that the tube holder is floating relative to the main pump housing. However, including those features provides the advantages outlined above.

In an alternative embodiment, rather than axially biasing the rotor relative to the pump head housing, the tube holder could be biased towards the rotor. Both the rotor and tube holder could be axially biased towards one another.

The invention claimed is:

1. A tube holder for use with a peristaltic pump, the tube holder comprising:

a housing having a recess for receipt of a pump rotor, a tube race for receipt of a tube around the recess and having a first race part around one part of the recess and a second race part around another part of the recess, a first tube inlet into the first race part and a first tube outlet from the first race part, a second tube inlet into the second race part and a second tube outlet from the second race part, the first race part extending between the first tube inlet and first tube outlet and comprising an occluding surface against which part of a tube can be compressed in use by a pump rotor, and the second race part extending between the second tube inlet and second tube outlet and comprising an occluding surface against which part of a tube can be compressed in use by the pump rotor;

the tube being insertable in the tube race by movement in a substantially orthogonal direction relative to the tube race so that it extends in through the first tube inlet, around the first race part, out through the first tube outlet, in through the second tube inlet, around the second race part, and out through the second tube outlet, and such that a portion of the tube between the first tube outlet and second tube inlet is external of the tube race.

2. A tube holder as claimed in claim 1, wherein the first tube outlet and second tube inlet are configured such that the tube can exit the housing between the first outlet and second inlet.

3. A tube holder as claimed in claim 1, wherein the first tube outlet and second tube inlet are in communication with a recess or groove which is separate to the tube race, but which is located within the housing.

4. A tube holder as claimed in claim 1, wherein the housing comprises a lip or projection between the first outlet and the second inlet, behind which the tube can be located to maintain the tube in position within the tube race.

5. A tube holder as claimed in claim 1, wherein the recess is tapered for receipt of a tapered pump rotor.

6. A tube holder as claimed in claim 5, wherein each tube race part is defined by a channel or groove extending inwardly from a respective tube inlet and tube outlet.

7. A tube holder as claimed in claim 6, wherein the grooves extend part way around the recess.

8. A tube holder as claimed in claim 1, wherein the tube holder is a one-piece article.

9. The combination of a tube holder as claimed in claim 1 and a pump head having a tapered rotor which is received in the recess of the tube holder, such that actuation of the pump head causes fluid to be pumped through a tube in the tube holder by occlusion of the tube.

10. The combination as claimed in claim 9, wherein the tube is resiliently flexible so that it returns substantially to its original shape following occlusion, to thereby suck fluid through the tube.

11. The combination as claimed in claim 9, wherein the rotor is axially biased towards its tapered end, such that the pump rotor and tube race are self-adjusting, to maintain a desired pressure on a tube in the tube race during pumping.

12. The combination as claimed in claim 11, wherein the rotor is axially biased by a compression spring.

13. The combination as claimed in claim 11, including a stop to limit the axial movement of the rotor relative to the housing.

14. The combination as claimed in claim 13, wherein the stop is in the form of an annular lip on the rotor.

15. The combination as claimed in claim 12, wherein the pump head comprises a transmission mechanism to transmit motive power from a power source to the rotor, and wherein the base of the tapered rotor comprises a plurality of gear teeth which engage with a gear of the transmission mechanism, and wherein the gear teeth of the rotor and the teeth of the gear of the transmission mechanism are of sufficient length to remain engaged during axial movement of the rotor.

16. The combination as claimed in claim 15, wherein the gear teeth of the rotor are elongate and longer than the teeth of the gear of the transmission mechanism.

17. The combination as claimed claim 9, wherein part of the rotor is substantially conical or frustoconical, and has a plurality of rollers rotatably mounted thereon which are configured to occlude the tube in use.

18. The combination as claimed in claim 17, wherein the rollers are substantially frustoconical in configuration, with their tapered ends directed towards the tapered end of the rotor.

19. The combination as claimed in claim 18, wherein the rollers are mounted for rotation with axes which taper toward the tapered end of the rotor.

20. The combination as claimed in claim 17, wherein the rotor comprises a main body part and a head part, with the rollers mounted for rotation in a recess or recesses between the main body part and the head part.

21. The combination as claimed in claim 9, wherein the tube holder and pump head are fully separable from an operable configuration in which the rotor is located in the recess of the tube holder and configured to pump fluid through a tube to a loading configuration in which the tube may be loaded into the tube race.

22. A method of loading a tube into a tube holder comprising:

providing a tube holder having a housing having a recess for receipt of a pump rotor, a tube race for receipt of a tube around the recess and having a first race part around one part of the recess and a second race part around another part of the recess, a first tube inlet into the first race part and a first tube outlet from the first race part, a second tube inlet into the second race part and a second tube outlet from the second race part, the first race part extending between the first tube inlet and first tube outlet and comprising an occluding surface against which part of a tube can be compressed in use by a pump rotor, and the second race part extending between the second tube inlet and second tube outlet and comprising an occluding surface against which part of a tube can be compressed in use by the pump rotor;

providing a tube; and moving the tube in a substantially orthogonal direction relative to the tube race such that it extends in through the first tube inlet, around the first race part, out through the first tube outlet, in through the second tube inlet, around the second race part, and out through the second tube outlet, and such that a portion of the tube between the first tube outlet and second tube inlet is external of the tube race.

23. A method as claimed in claim 22, wherein the tube holder comprises a retainer which is in the form of a projection or lip between the first outlet and the second inlet, and wherein the method further comprises pulling the installed tube in a direction away from the projection or lip so that the tube is maintained in position within the tube race with part of the tube located behind the projection or lip.

24. A method as claimed in claim 22, wherein the method comprises bringing the tube holder into engagement with a pump head to provide the combination of a tube holder and a pump head, and so that the rotor is located in the recess in the tube holder.

25. A method as claimed in claim 24, wherein the pump head comprises a tapered rotor which is received in the recess of the tube holder, such that actuation of the pump head causes fluid to be pumped through a tube in the tube holder by occlusion of the tube against the occluding surfaces of the tube race.

26. The combination of a peristaltic pump head having a tapered pump rotor which is rotatable about an axis of rotation, and a tube holder having a recess for receipt of the tapered end of the rotor, the tube holder having a tube race configured for receipt of a tube for pumping of a fluid by movement of the rotor, the tube race comprising a first race part around one part of the recess and a second race part around another part of the recess, a first tube inlet into the first race part and a first tube outlet from the first race part, a second tube inlet into the second race part and a second tube outlet from the second race part, the first race part extending between the first tube inlet and first tube outlet and comprising an occluding surface against which part of a tube can be compressed in use by the tapered pump rotor, and the second race part extending between the second tube inlet and second tube outlet and comprising an occluding surface against which part of a tube can be compressed in use by the tapered pump rotor, wherein a tube can be inserted into the tube race so that it extends in through the first tube inlet, around the first race part, out through the first tube outlet, in through the second tube inlet, around the second race part, and out through the second tube outlet, such that the tube exits and re-enters the tube race, and such that a portion of the tube between the first tube outlet and second tube inlet is external of the tube race.

27. The combination as claimed in claim 26, wherein the tube is insertable into the tube race without separating the tube holder from the pump head.

28. The combination as claimed in claim 26, wherein the tube holder and pump head are movable from an operable configuration in which the rotor is located in the recess of the tube holder and configured to pump fluid through a tube to a loading configuration in which the tube may be loaded into the tube race.

29. The combination as claimed in claim 28, wherein the tube holder and pump head are fully separable.

30. The combination as claimed in claim 26, wherein the tube holder has a housing, the first race part around one part of the recess defined by a first tube inlet aperture and a first tube outlet aperture, the second race part around another part of the recess defined by a second tube inlet aperture and a second tube outlet aperture, such that movement of a tube threaded therethrough in the axial direction of the rotor is minimized or prevented by the apertures.

31. The combination as claimed in claim 28, wherein the tube holder comprises:

a housing having a recess for receipt of a pump rotor, the tube race for receipt of a tube around the recess and having the first race part around one part of the recess and the second race part around another part of the recess, the first tube inlet into the first race part and the first tube outlet from the first race part, the second tube inlet into the second race part and the second tube outlet from the second race part;

the tube being insertable in the tube race by movement in a substantially orthogonal direction relative to the tube race so that it extends in through the first tube inlet, around the first race part, out through the first tube outlet, in through the second tube inlet, around the second race part, and out through the second tube outlet.

32. The combination as claimed in claim 31, wherein the tube is resiliently flexible so that it returns substantially to its original shape following occlusion, to thereby suck fluid through the tube.

33. The combination as claimed in claim 31, wherein the rotor is axially biased towards its tapered end, such that the pump rotor and tube race are self-adjusting, to maintain a desired pressure on a tube in the tube race during pumping.

34. The combination as claimed in claim 33, wherein the rotor is axially biased by a compression spring.

35. The combination as claimed in claim 33, comprising a stop to limit the axial movement of the rotor relative to the housing.

36. The combination as claimed in claim 35, wherein the stop is in the form of an annular lip on the rotor.

37. The combination as claimed in claim 34, wherein the pump head comprises a transmission mechanism to transmit motive power from a power source to the rotor, and wherein the base of the tapered rotor comprises a plurality of gear teeth which engage with a gear of the transmission mechanism, and wherein the gear teeth of the rotor and the teeth of the gear of the transmission mechanism are of sufficient length to remain engaged during axial movement of the rotor.

38. The combination as claimed in claim 37, wherein the gear teeth of the rotor are elongate and longer than the teeth of the gear of the transmission mechanism.

39. The combination as claimed in claim 26, wherein the tapered part of the rotor is substantially conical or frustoconical, and has a plurality of rollers rotatably mounted thereon which are configured to occlude the tube in use.

40. The combination as claimed in claim 39, wherein the rollers are substantially frustoconical in configuration, with their tapered ends directed towards the tapered end of the rotor.

41. The combination as claimed in claim 40, wherein the rollers are mounted for rotation with axes which taper toward the tapered end of the rotor.

42. The combination as claimed in claim 39, wherein the rotor comprises a main body part and a head part, with the rollers mounted for rotation in a recess or recesses between the main body part and the head part.

* * * * *